US011098703B2

(12) United States Patent
Taguchi et al.

(10) Patent No.: US 11,098,703 B2
(45) Date of Patent: Aug. 24, 2021

(54) VARIABLE DISPLACEMENT COMPRESSOR WITH VARIATION IN DISCHARGE CAPACITY

(71) Applicant: SANDEN AUTOMOTIVE COMPONENTS CORPORATION, Isesaki (JP)

(72) Inventors: Yukihiko Taguchi, Isesaki (JP); Takashi Toida, Isesaki (JP); Satoshi Terauchi, Isesaki (JP); Tomohiro Iguchi, Isesaki (JP); Yoshie Matsuzaki, Isesaki (JP)

(73) Assignee: Sanden Automotive Components Corporation, Isesaki (JP)

( * ) Notice: Subject to any disclaimer, the term of this patent is extended or adjusted under 35 U.S.C. 154(b) by 91 days.

(21) Appl. No.: 16/494,935

(22) PCT Filed: Feb. 9, 2018

(86) PCT No.: PCT/JP2018/005605
§ 371 (c)(1),
(2) Date: Sep. 17, 2019

(87) PCT Pub. No.: WO2018/186033
PCT Pub. Date: Oct. 11, 2018

(65) Prior Publication Data

US 2020/0095986 A1 Mar. 26, 2020

(30) Foreign Application Priority Data

Apr. 6, 2017 (JP) ..... JP2017-076182

(51) Int. Cl.
*F04B 27/18* (2006.01)

(52) U.S. Cl.
CPC .. *F04B 27/1804* (2013.01); *F04B 2027/1813* (2013.01); *F04B 2027/1827* (2013.01); *F04B 2027/1831* (2013.01)

(58) Field of Classification Search
CPC ..... F04B 27/1804; F04B 2027/1813; F04B 2027/1827; F04B 2027/1831; F04B 53/22
See application file for complete search history.

(56) References Cited

U.S. PATENT DOCUMENTS

2002/0006337 A1* 1/2002 Kimura ..... F04B 27/1804 417/222.2
2002/0031432 A1* 3/2002 Ota ..... F04B 27/1804 417/222.2

(Continued)

FOREIGN PATENT DOCUMENTS

| | | | |
|---|---|---|---|
| EP | 1 070 845 | A1 | 1/2001 |
| JP | 2016-108960 | A | 6/2016 |
| WO | 2016/088735 | A1 | 6/2016 |

OTHER PUBLICATIONS

Japan Patent Office, International Search Report issued in International Application No. PCT/JP2018/005605, dated May 22, 2018.

*Primary Examiner* — Peter J Bertheaud
(74) *Attorney, Agent, or Firm* — Baker Botts L.L.P.

(57) ABSTRACT

Provided is a variable displacement compressor capable of preventing intrusion of foreign matter into a second control valve. A variable displacement compressor 100 is equipped with a first control valve 300 controlling the opening degree of a supply passage 145, a check valve 350, a second control valve 400 controlling the opening degree of a discharge passage 146, and a back-pressure relief passage 147. The second control valve 400 has a back-pressure chamber 410 communicating with an intermediate supply passage **145*b*1, a valve chamber 420 in which a valve hole 103*d* and a discharge hole 431*a*** are open and which constitutes a part of (Continued)

the discharge passage 146, a dividing member 430 dividing the back-pressure chamber 410 and the valve chamber 420 from each other, and a spool 440. In a state in which the first control valve 300 closes the supply passage 145 and in which a valve seat side end surface 442*a* of a valve portion 442 of the spool 440 is spaced away from a valve seat 103*f* to a maximum degree, an end wall side end surface 442*b* of the valve portion 442 abuts an end wall 432 of the dividing member 430, whereby communication between the valve chamber 420 and the back-pressure chamber 410 via a through-hole 432*a* of the end wall 432 is cut off.

2 Claims, 11 Drawing Sheets

(56) References Cited

U.S. PATENT DOCUMENTS

| | | | | |
|---|---|---|---|---|
| 2005/0008499 | A1* | 1/2005 | Umemura | F04B 39/16 417/222.2 |
| 2011/0214564 | A1* | 9/2011 | Okuda | F04B 27/1804 91/505 |
| 2017/0356439 | A1 | 12/2017 | Taguchi | |

* cited by examiner

VARIABLE DISPLACEMENT COMPRESSOR WITH VARIATION IN DISCHARGE CAPACITY

CROSS-REFERENCE TO RELATED APPLICATIONS

This application is a U.S. National Stage Patent Application under 35 U.S.C. § 371 of International Patent Application No. PCT/JP2018/005605, filed on Feb. 9, 2018, which claims the benefit of Japanese Patent Application No. 2017-076182, filed on Apr. 6, 2017, the disclosures of each of which are incorporated herein by reference in their entirety.

TECHNICAL FIELD

The present invention relates to variable displacement compressors that vary in discharge capacity in response to pressure of a control pressure chamber, such as a crank chamber.

BACKGROUND ART

Patent Document 1 discloses an example of a variable displacement compressor of this type, which includes: a first control valve controlling the opening degree of a pressure supply passage establishing communication between a discharge chamber and a crank chamber; a second control valve controlling the opening degree of a pressure release passage establishing communication between the crank chamber and a suction chamber; and a check valve provided between the first control valve in the pressure supply passage and the crank chamber and preventing backflow of refrigerant flowing from the crank chamber toward the first control valve, wherein the discharge capacity is controlled through pressure control in the crank chamber.

The second control valve has: a back-pressure chamber communicating with a region of the pressure supply passage on the downstream side of the first control valve via a communication passage; a valve chamber divided from the back-pressure chamber by a dividing member, constituting a part of the pressure release passage, and having in a wall surface on the side opposite the back-pressure chamber a valve hole communicating with the crank chamber; and a spool having a shaft portion extending through a pressure receiving portion arranged in the back-pressure chamber, a valve portion arranged in the valve chamber, and the dividing member and connecting the pressure receiving portion and the valve portion. In the second control valve, when the first control valve is opened and a force moving the spool toward the valve hole by the pressure applied to the pressure receiving portion becomes greater than a force moving the spool away from the valve hole by the pressure applied to the valve portion, the valve portion abuts the wall surface of the valve chamber to close the valve hole to minimize the opening degree of the pressure release passage, and when the first control valve is closed and a force moving the spool toward the valve hole by the pressure applied to the pressure receiving portion becomes smaller than a force moving the spool away from the valve hole by the pressure applied to the valve portion, the valve portion is separated from the wall surface to open the valve hole to maximize the opening degree of the pressure release passage.

REFERENCE DOCUMENT LIST

Patent Document

Patent Document 1: JP 2016-108960 A

SUMMARY OF THE INVENTION

Problem to be Solved by the Invention

In the conventional variable displacement compressor, the first control valve is placed in the closed valve state in which it closes the pressure supply passage and in which the check valve prevents backflow, and refrigerant in the crank chamber flows into the valve chamber of the second control valve via the valve hole, whereby the spool moves in the direction so as to maximize the opening degree of the pressure release passage (the direction so as to move away from the valve hole).

Here, in a conventional variable displacement compressor, minute foreign matter may flow through the pressure release passage, etc. along with the refrigerant. In the conventional variable displacement compressor, however, in the state in which the spool opens the pressure release passage to maximum, the valve chamber communicates with the back-pressure chamber via a through-hole for shaft portion insertion formed in the dividing member. Thus, if the refrigerant flows from the valve hole into the valve chamber along with foreign matter in the state in which the spool opens the pressure release passage to maximum, some of the refrigerant may flow into the back-pressure chamber via the through-hole along with the foreign matter. If foreign matter flows into the back-pressure chamber, the operation of the spool may be hindered, and there is a demand for some preventative measure in this regard.

An object of the present invention is to provide a variable displacement compressor capable of preventing or suppressing intrusion of foreign matter into the second control valve controlling the opening degree of the discharge passage.

Means for Solving the Problem

According to an aspect of the present invention, there is provided a variable displacement compressor having a suction chamber to which refrigerant is directed, a compressing portion configured to draw in the refrigerant from the suction chamber and compress the refrigerant, a discharge chamber into which the refrigerant compressed by the compressing portion is discharged, and a control pressure chamber, the variable displacement compressor undergoing variation in discharge capacity in response to the pressure of the control pressure chamber. The variable displacement compressor includes a first control valve, a check valve, a second control valve, and a back-pressure relief passage. The first control valve is provided in a supply passage for supplying the refrigerant in the discharge chamber to the control pressure chamber, and controls the opening degree of the supply passage. The check valve is provided in a downstream side supply passage between the first control valve and the control pressure chamber in the supply passage, and operates so as to prevent backflow of the refrigerant flowing from the control pressure chamber toward the first control valve. The second control valve is provided in a discharge passage for discharging the refrigerant in the control pressure chamber into the suction chamber, and controls the opening degree of the discharge passage. The back-pressure relief passage connects an intermediate supply passage between the first control valve and the check valve in the downstream side supply passage with the suction chamber in communication therebetween, and has a throttle portion. The second control valve has a back-pressure chamber, a valve chamber, a dividing member, and a spool. The back-pressure chamber communicates with the intermediate supply passage. In the valve chamber, a valve hole communicating with an upstream side discharge passage between the second control valve and the control pressure chamber in the discharge passage, and a discharge hole communicating with the suction chamber are open, constituting a part of the discharge passage. The dividing member divides the back-pressure chamber from the valve chamber, and has a tubular peripheral wall and an end wall connected to one end side of the peripheral wall so that an inner space surrounded by the peripheral wall defines the valve chamber. The spool, which has a circular sectional configuration and extends in one direction, has a pressure receiving portion, a valve portion, and a shaft portion. The pressure receiving portion is arranged inside the back-pressure chamber. The valve portion is arranged inside the valve chamber and is configured to move to and away from a valve seat around the valve hole. The shaft portion extends through a through-hole formed in the end wall of the dividing member, connects the pressure receiving portion and the valve portion, and has an outer diameter smaller than the outer diameters of the pressure receiving portion and the valve portion. The second control valve is configured to move the spool in response to the pressure in the back-pressure chamber and the pressure in the upstream side discharge passage so as to move the valve portion to and away from the valve seat, thereby controlling the opening degree of the discharge passage. The valve portion has a valve seat side end surface facing the valve seat, and an end wall side end surface facing the end wall of the dividing member. In the state in which the first control valve closes the supply passage and in which the valve seat side end surface is spaced away from the valve seat to a maximum, the end wall side end surface comes into contact with the end wall, whereby communication between the valve chamber and the back-pressure chamber via the through-hole is cut off.

Effects of the Invention

In the variable displacement compressor according to an aspect of the present invention, in the state in which the valve seat side end surface is spaced away from the valve seat to a maximum, the end wall side end surface abuts the end wall, whereby the second control valve cuts off communication between the valve chamber and the back-pressure chamber via the through-hole. As a result, even when minute foreign matter flows through the discharge passage along with the refrigerant and flows into the valve chamber, all or the major part of the minute foreign matter flows into the suction chamber via the open discharge passage along with the refrigerant. As a result, it is possible to prevent or suppress intrusion of the foreign matter into the back-pressure chamber. Thus, even when minute foreign matter is circulating along with the refrigerant, it is possible to operate the spool in a satisfactory manner. In this way, it is possible to provide a variable displacement compressor capable of preventing or suppressing intrusion of foreign matter into the second control valve.

MODE FOR CARRYING OUT THE INVENTION

In the following, an embodiment of the present invention will be described in detail with reference to the appended drawings.

Figure 1:
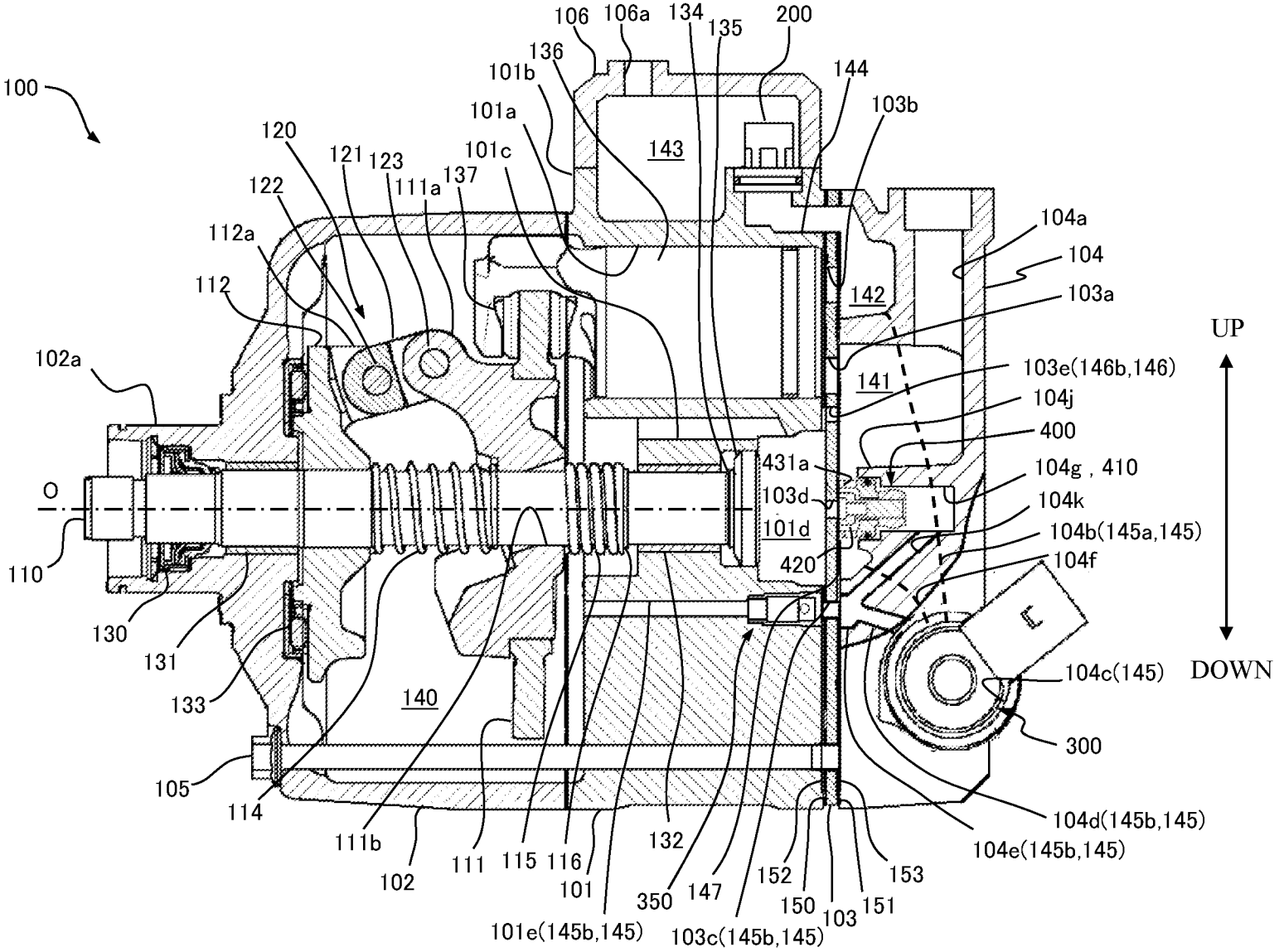
FIG. 1 is a sectional view of a variable displacement compressor according to an embodiment of the present invention.

FIG. 1 illustrates, by way of example, a variable displacement type clutchless compressor applicable to a vehicle air conditioner system. FIG. 1 illustrates a state in which this variable displacement type clutchless compressor is mounted in a vehicle (i.e., the compressor installed state). In the drawing, the upper side is the upper side in the gravitational direction, and the lower side is the lower side in the gravitational direction.

FIG. 1 illustrates a variable displacement compressor 100 equipped with a cylinder block 101 having a plurality of cylinder bores 101*a*, a front housing 102 provided at one end of the cylinder block 101, and a cylinder head 104 provided at the other end of the cylinder block 101 via a valve plate 103. A crank chamber 140 as a control pressure chamber is formed by the cylinder block 101 and the front housing 102, and a drive shaft 110 is provided across the crank chamber 140.

Around the intermediate portion in the extending direction of the axis O of the drive shaft 110, there is arranged a swash plate 111. The swash plate 111 is connected to a rotor 112 fixed to the drive shaft 110 via a link mechanism 120, with its inclination with respect to the axis O being variable. The link mechanism 120 is equipped with a first arm 112*a* protruding from the rotor 112, a second arm 111*a* protruding from the swash plate 111, and a link arm 121 one end of which is rotatably connected to the first arm 112*a* via a first connection pin 122 and the other end of which is rotatably connected to the second arm 111*a* via a second connection pin 123.

A through-hole 111*b* of the swash plate 111 is formed in a configuration allowing the swash plate 111 to tilt within a range between a maximum inclination and a minimum inclination, and the through-hole 111*b* has a minimum inclination regulating portion abutting the drive shaft 110. In a case in which the inclination of the swash plate 111 when the swash plate 111 is orthogonal to the drive shaft 110 is 0 degrees, the minimum inclination regulating portion of the through-hole 111*b* is formed so as to be capable of inclining the swash plate 111 substantially to 0 degrees. Furthermore, the maximum inclination of the swash plate 111 is regulated by the swash plate 111 abutting the rotor 112.

Between the rotor 112 and the swash plate 111, there is attached an inclination reducing spring 114 urging the swash plate 111 so as to reduce the inclination of the swash plate 111. Furthermore, between the swash plate 111 and a spring support member 116 provided on the drive shaft 110, there is attached an inclination increasing spring 115 urging the swash plate 111 in the direction so as to increase the inclination of the swash plate 111. Here, the urging force of the inclination increasing spring 115 at the minimum inclination is set to be larger than the urging force of the inclination reducing spring 114. When the drive shaft 110 is not rotating, the swash plate 111 is set in position at an inclination where the urging force of the inclination reducing spring 114 and the urging force of the inclination increasing spring 115 are balanced.

One end of the drive shaft 110 extends through a boss portion 102*a* protruding to the outside of a front housing 102 to the outer side of the front housing 102, and is connected to a power transmission device (not illustrated). Between the drive shaft 110 and the boss portion 102*a*, there is inserted a shaft sealing device 130, cutting off the crank chamber 140 from the outer space.

The connection body of the drive shaft 110 and the rotor 112 is supported in the radial direction by bearings 131 and 132, and is supported in the thrust direction by a bearing 133 and a thrust plate 134. Power from an external drive source is transmitted to the power transmission device, and the drive shaft 110 is rotatable in synchrony with the rotation of the power transmission device. The gap between the portion of the drive shaft 110 where the thrust plate 134 abuts and the thrust plate 134 is adjusted to a predetermined gap by an adjustment screw 135.

In each cylinder bore 101*a*, there is arranged a piston 136, and accommodated in the inner space of the end portion of the piston 136 protruding on the crank chamber 140 side is the outer peripheral portion of the swash plate 111, and the swash plate 111 operates in conjunction with the piston 136 via a pair of shoes 137. The piston 136 reciprocates within the cylinder bore 101*a* through the rotation of the swash plate 111. At the central portion of a cylinder head 104, there is formed a suction chamber 141, and there is defined a discharge chamber 142 annularly surrounding the outer side in the radial direction of the suction chamber 141.

The suction chamber 141 and the cylinder bore 101*a* communicate with each other via a communication hole 103*a* provided in a valve plate 103 and a suction valve (not illustrated) formed in a suction valve forming plate 150. A discharge chamber 142 and the cylinder bore 101*a* communicate with each other via a communication hole 103*b* provided in the valve plate 103 and a discharge valve (not illustrated) formed in a discharge valve forming plate 151.

In the present embodiment, the front housing 102, a center gasket (not illustrated), the cylinder block 101, a cylinder gasket 152, the suction valve forming plate 150, the valve plate 103, the discharge valve forming plate 151, a head gasket 153, and a cylinder head 104 are successively connected to each other, and are fastened by a plurality of through-bolts 105 to form a compressor housing. In the present embodiment, the suction chamber 141 and the discharge chamber 142 are formed in the cylinder head 104 as a housing member constituting one end portion of the compressor housing. More specifically, the suction chamber 141 is arranged in an extension line of the axis O of the drive shaft 110 extending through the compressor housing from the other end portion to one end portion of the compressor housing, and the discharge chamber 142 is formed annularly so as to surround the suction chamber 141 on the outer side in the radial direction orthogonal to the axis O of the suction chamber 141. In the present embodiment, the extending direction of the axis O of the drive shaft 110 corresponds to the center axis extending direction of the compressor housing.

Furthermore, as seen in FIG. 1, a muffler is provided above the cylinder block 101. The muffler is formed by fastening a cover member 106 opening a discharge port 106*a* and a formation wall 101*b* defined above the cylinder block 101 by bolts via a seal member (not illustrated). A discharge check valve 200 is arranged in a muffler space 143 surrounded by the cover member 106 and the formation wall 101*b*.

The discharge check valve 200 is arranged at a connection portion between a communication passage 144 communicating the discharge chamber 142 with the muffler space 143 and the muffler space 143, and operates in response to a pressure difference between the communication passage 144 (upstream side) and the muffler space 143 (downstream side). In the case in which the pressure difference is smaller than a predetermined value, it cuts off the communication passage 144, and in the case in which the pressure difference is greater than a predetermined value, it opens the communication passage 144. Thus, the discharge chamber 142 is connected to the refrigerant circuit (the high pressure side thereof) of an air conditioning system via a discharge passage formed by the communication passage 144, the discharge check valve 200, the muffler space 143, and the discharge port 106*a*.

In the cylinder head 104, a suction passage 104*a* extends linearly from the outer side in the radial direction of the cylinder head 104 across a part of the discharge chamber 142, and the suction chamber 141 is connected to the suction side refrigerant circuit of the air conditioning system via this suction passage 104*a*.

The refrigerant on the low pressure side of the refrigerant circuit of the air conditioning system is directed to the suction chamber 141 via the suction passage 104*a*. The refrigerant in the suction chamber 141 is drawn into the cylinder bore 101*a* through the reciprocal movement of the piston 136, and is compressed before being discharged into the discharge chamber 142. That is, in the present embodiment, the compressing portion drawing in the refrigerant from the suction chamber 141 and compressing the refrigerant is formed by the cylinder bore 101*a* and the piston 136. The refrigerant discharged into the discharge chamber 142 (the refrigerant compressed by the compressing portion) is directed to the high pressure side of the refrigerant circuit of the air conditioning system via the discharge passage.

A supply passage 145 is formed in the cylinder head 104. This supply passage 145 is provided with a first control valve 300 and a check valve 350. Formed in the cylinder block 101 and the cylinder head 104 is a discharge passage 146. This discharge passage 146 is provided with a second control valve 400. Between the cylinder block 101 and the cylinder head 104, there is provided a back-pressure relief passage 147.

Supply Passage

Figure 2:
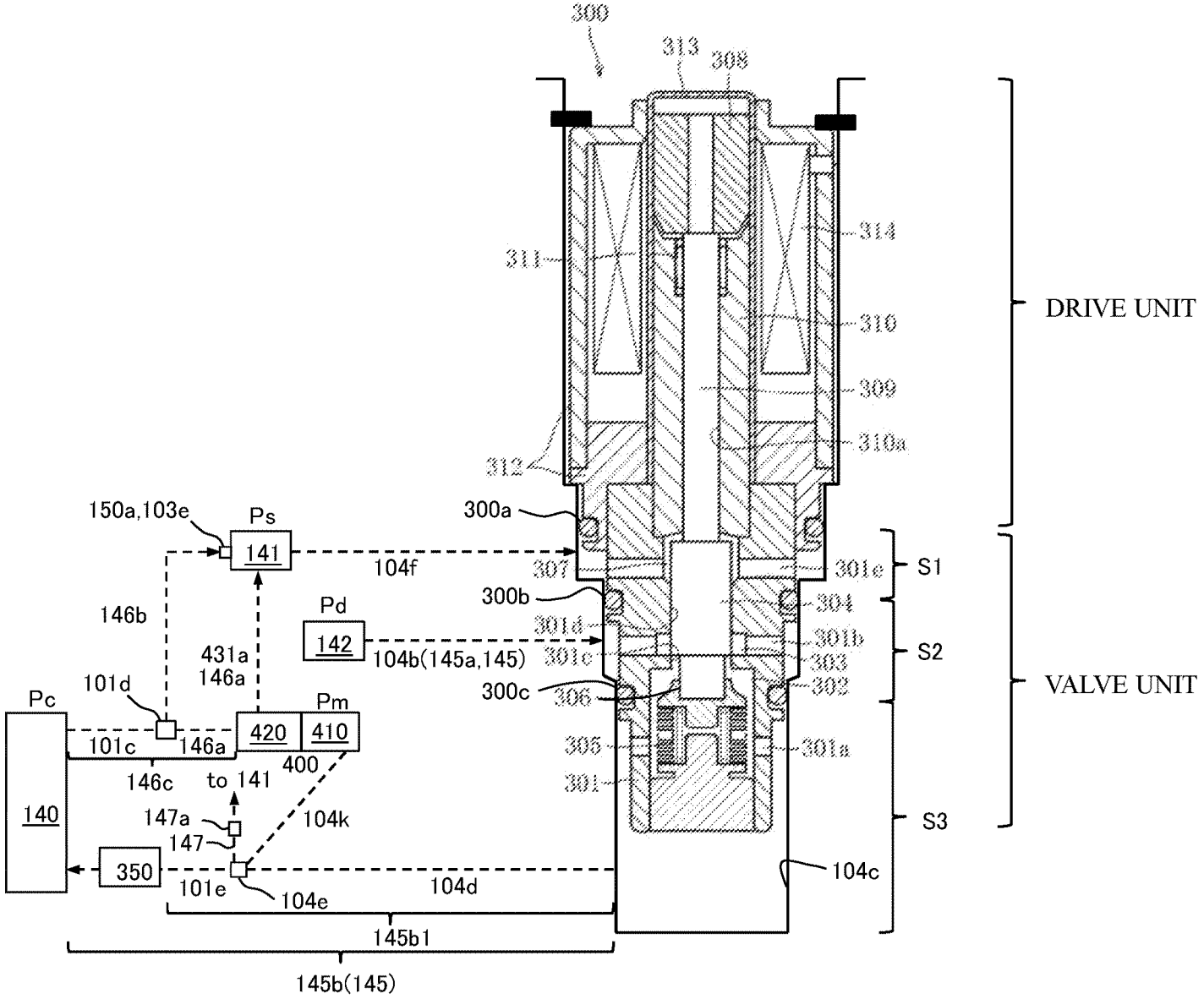
FIG. 2 is a sectional view of a first control valve of the variable displacement compressor and a conceptual drawing illustrating a passage system through which refrigerant circulates.
Figure 3:
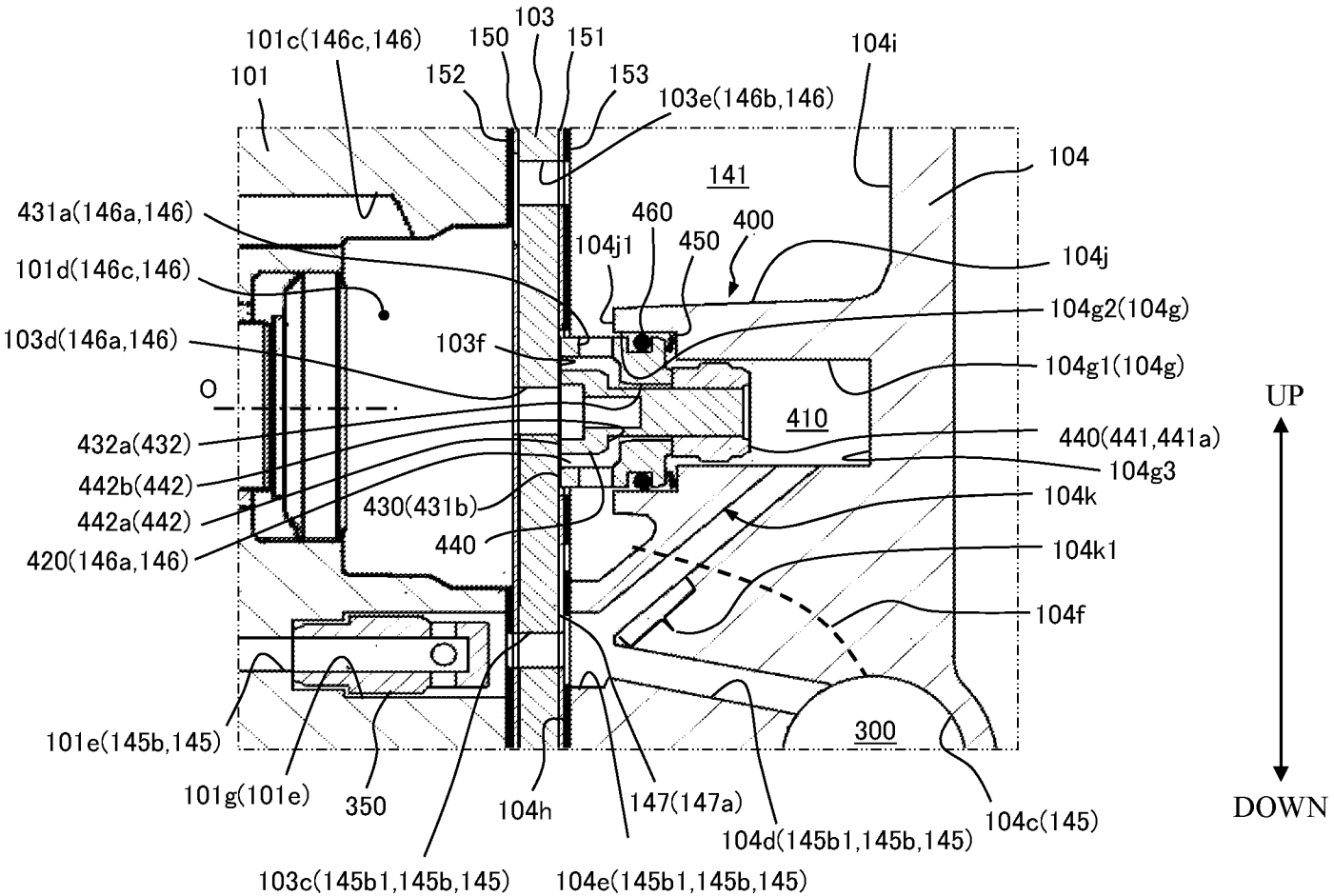
FIG. 3 is an enlarged main portion sectional view of the variable displacement compressor.

FIG. 2 is a sectional view of the first control valve 300, and is a conceptual drawing illustrating the passage system through which the refrigerant is circulated, and FIG. 3 is a main portion sectional view of the variable displacement compressor 100 including the check valve 350 and the second control valve 400. The supply passage 145 is a passage for supplying the refrigerant in the discharge chamber 142 to the crank chamber 140. Here, the portion of the supply passage 145 between the discharge chamber 142 and the first control valve 300 is referred to as an upstream side supply passage 145*a*, and the portion of the supply passage 145 between the first control valve 300 and the crank chamber 140 is referred to as a downstream side supply passage 145*b*. As described below, the supply passage 145 extends via the first control valve 300, and is opened and closed by the first control valve 300. The check valve 350 is provided in the downstream side supply passage 145*b*.

In the present embodiment, the supply passage 145 extends via a communication passage 104*b* formed in the cylinder head 104, a second region S2 (See FIG. 2), described below, of an accommodating hole 104*c* for the first control valve 300 formed in the cylinder head 104, the interior of the first control valve 300 (See FIG. 2) described below, a third region S3 (See FIG. 2) of the accommodating hole 104*c*, a communication passage 104*d* formed in the cylinder head 104, a connection portion 104*e* open in a connection end surface 104*h* of the cylinder head 104 connected to the cylinder block 101 (head gasket 153), a communication hole of the head gasket 153, a communication hole of the discharge valve forming plate 151, a communication hole 103*c* formed in the valve plate 103, a communication hole of the suction valve forming plate 150, a valve hole 152*a* formed in a cylinder gasket 152, a communication passage 101*e* extending through the cylinder block 101, and a second passage 351*c*2 and a first passage 351*c*1, described below, of the check valve 350 (See FIGS. 7A and 7B mentioned below), and establishes communication between the discharge chamber 142 and the crank chamber 140. Thus, in the present embodiment, the communication passage 104*b* constitutes the upstream side supply passage 145*a*, and the passage consisting of the third region S3 (See FIG. 2), the communication passage 104*d*, the connection portion 104*e*, the communication hole of the head gasket 153, the communication hole of the discharge valve forming plate 151, the communication hole 103*c*, the communication hole of the suction valve forming plate 150, the valve hole 152*a* of the cylinder gasket 152, the communication passage 101*e*, and the second passage 351*c*2 and the first passage 351*c*1 constitutes the downstream side supply passage 145*b*.

Discharge Passage

The discharge passage 146 is a passage for discharging the refrigerant in the crank chamber 140 into the suction chamber 141. As illustrated in FIGS. 1 through 3, in the present embodiment, the discharge passage 146 branches off into two passages on the suction chamber 141 side. One passage thereof (a first discharge passage 146*a* described below) extends via the second control valve 400, and is opened and closed by the second control valve 400. In the present embodiment, the discharge passage 146 has a communication passage 101*c* extending through the front housing 102 side end surface of the cylinder block 101 to the cylinder head 104 side, and a space 101*d* to which the communication passage 101*c* is connected and which is open in the cylinder head 104 side end surface of the cylinder block 101.

Figure 4:
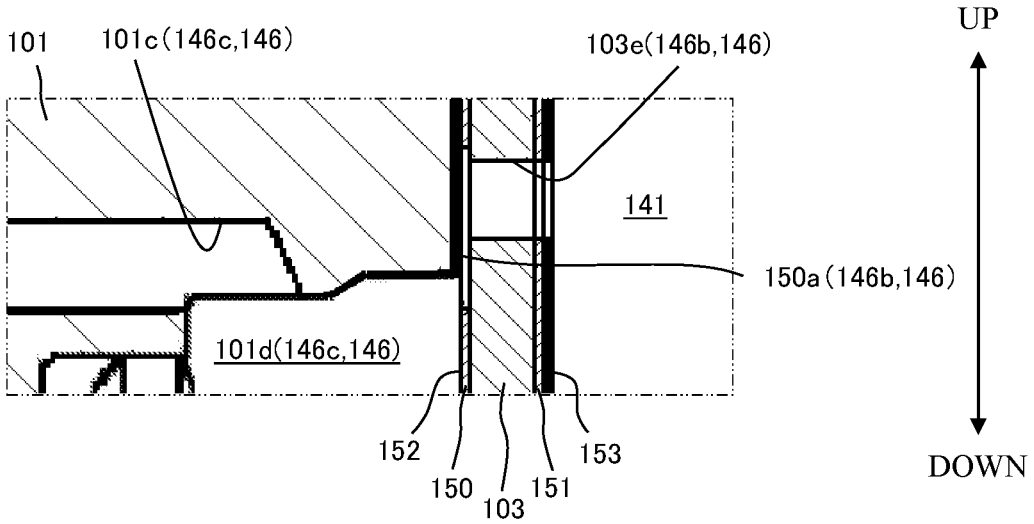
FIG. 4 is an enlarged partial sectional view including a part of the discharge passage of the variable displacement compressor.

FIG. 4 is a partial enlarged view including a part of the discharge passage 146 (a second discharge passage 146*b* described below).

As illustrated in FIGS. 1 through 3, in the present embodiment, the discharge passage 146 branches off from the space 101*d* into the first discharge passage 146*a* and the second discharge passage 146*b*. The first discharge passage 146*a* is formed so as to extend from the space 101*d* via the communication hole of the cylinder gasket 152, the communication hole of the suction valve forming plate 150, the valve hole 103*d*, described below, extending through the valve plate 103, a valve chamber 420, described below, of the second control valve 400, and a discharge hole 431*a* and to open into the suction chamber 141. As illustrated in FIG. 4, the second discharge passage 146*b* extends from the space 101*d* via the communication hole formed in the cylinder gasket 152, a groove portion 150*a* as a stationary throttle formed in the suction valve forming plate 150, a communication hole 103*e* formed in the valve plate 103, a communication hole of the discharge valve forming plate 151, and a communication hole of the head gasket 153, and bypasses the second control valve 400, constantly maintaining communication between the space 101*d* and the suction chamber 141. The passage between the second control valve 400 in the discharge passage 146 and the crank chamber 140 is referred to as an upstream side discharge passage 146*c* (See FIG. 2). The flow passage sectional area of the first discharge passage 146*a* when opened by the second control valve 400 is set to be larger than the flow passage sectional area of the groove portion 150*a* as the stationary throttle of the second discharge passage 146*b*.

Back-Pressure Relief Passage (Throttle Passage)

As illustrated in FIGS. 2 and 3, the back-pressure relief passage 147 provides communication between the intermediate supply passage 145*b*1 between the first control valve 300 in the downstream side supply passage 145*b* and the check valve 350 and the suction chamber 141, and is a passage as a throttle passage having a throttle portion 147*a*.

Figure 5:
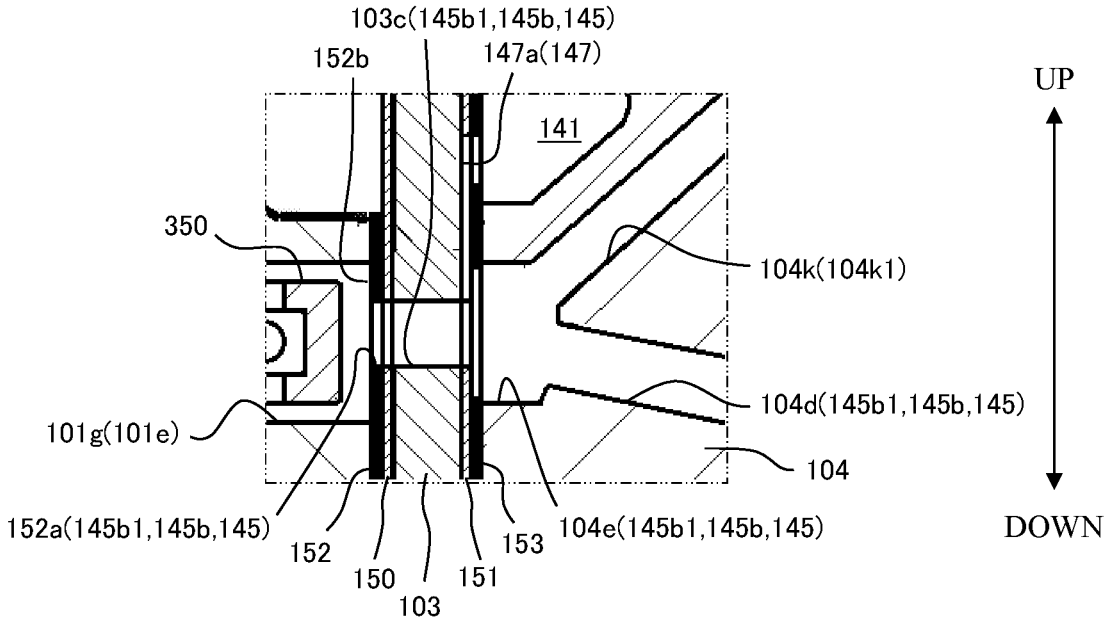
FIG. 5 is an enlarged partial sectional view including a back-pressure relief passage of the variable displacement compressor.

FIG. 5 is a partial enlarged view including the back-pressure relief passage 147.

In the present embodiment, the throttle portion 147*a* consists of a groove portion formed so as to extend through the discharge valve forming plate 151, and this groove is open to the connection portion 104*e* and is open to the communication hole of the head gasket 153. In the present embodiment, the back-pressure relief passage 147 extends via the throttle portion 147*a* formed in the discharge valve forming plate 151 and the communication hole of the head gasket 153, constantly maintaining communication between the connection portion 104*e* (that is, the intermediate supply passage 145*b*1) and the suction chamber 141.

The intermediate supply passage 145*b*1 (See FIG. 2) of the downstream side supply passage 145*b* is formed by the third region S3 (See FIG. 2), the communication passage 104*d*, the connection portion 104*e*, the communication hole of the head gasket 153, the communication hole of the discharge valve forming plate 151, the communication hole 103*c*, the communication hole of the suction valve forming plate 150, the valve hole 152*a* of the cylinder gasket 152, and the passage between the connection portion 104*e* of the communication passage 101*e* and the check valve 350.

In the case in which the first control valve 300 is closed, the refrigerant in the intermediate supply passage 145*b*1 flows out into the suction chamber 141 via the back-pressure relief passage 147. As a result, the pressure of the intermediate supply passage 145*b*1 and a back-pressure chamber 410, described below, of the second control valve 400 is reduced. As a result, as described below, the check valve 350 and a spool 440 of the second control valve 400 move.

Outline of First Control Valve

The first control valve 300 is a valve controlling the opening area (opening degree) of the supply passage 145. More specifically, as illustrated in FIGS. 1 and 2, the first control valve 300 is accommodated in the accommodating hole 104*c* formed in the cylinder head 104. In the present embodiment, O-rings 300*a* through 300*c* are attached to the first control valve 300, and due to these O-rings 300*a* through 300*c*, there are defined inside the accommodating hole 104*c*, a first region 51 communicating with the suction chamber 141 via the communication passage 104*f*, a second region S2 communicating with the discharge chamber 142 via the communication passage 104*b*, and a third region S3 communicating with the crank chamber 140 via the communication passage 104*d*, the connection portion 104*e*, the communication passage 101*e*, and the check valve 350. The second region S2 and the third region S3 of the accommodating hole 104*c* constitute a part of the supply passage 145. The first control valve 300 controls (adjusts) the opening degree of the supply passage 145 in response to the pressure of the suction chamber 141 directed via the communication passage 104*f* and an electromagnetic force generated by an electric current flowing through a solenoid in response to an external signal, controlling the discharge gas introduction amount (pressure supply amount) to the crank chamber 140.

Outline of Check Valve

The check valve 350 is a valve provided in the downstream side supply passage 145*b* of the supply passage 145 (in other words, the portion of the supply passage 145 on the downstream side of the first control valve 300) and is operable to prevent backflow of the refrigerant flowing from the crank chamber 140 toward the first control valve 300 and allowing flow of the refrigerant from the first control valve 300 toward the crank chamber 140. More specifically, the check valve 350 is formed at the valve plate 103 side opening end portion of the communication passage 101*e* of the cylinder block 101, and is accommodated in the accommodating hole 101*g* constituting a part of the communication passage 101*e*.

Outline of Second Control Valve

The second control valve 400 is a valve provided in the discharge passage 146 (the first discharge passage 146*a* in the present embodiment) and controlling the opening degree of the discharge passage 146. More specifically, the second control valve 400 is accommodated in the accommodating hole 104*g* formed in the cylinder head 104 and open to the suction chamber 141, and includes the spool 440 for opening and closing the first discharge passage 146*a* of the discharge passage 146. The second control valve 400 moves the spool 440 in response to the pressure of the intermediate supply passage 145*b*1 between the first control valve 300 of the downstream side supply passage 145*b* and the check valve 350 (more specifically, the pressure in a back-pressure chamber 410 described below) and the pressure of the crank chamber 140 (more specifically, the pressure in the upstream side discharge passage 146*c*) to thereby control (adjust) the opening degree of the discharge passage 146, and controls the discharge amount of the refrigerant from the crank chamber 140 to the suction chamber 141.

When the first control valve 300 and the check valve 350 are closed, the second control valve 400 opens the first discharge passage 146*a*. In this case, the discharge passage 146 is formed by the first discharge passage 146*a* and the second discharge passage 146*b*. As a result, the refrigerant in the crank chamber 140 quickly flows into the suction chamber 141, and the pressure of the crank chamber 140 becomes equivalent to the pressure of the suction chamber 141. The inclination of the swash plate becomes maximum, and the piston stroke (discharge capacity) becomes maximum.

When the first control valve 300 and the check valve 350 are open, the second control valve 400 closes the first discharge passage 146*a*. In this case, the discharge passage 146 is formed solely by the second discharge passage 146*b*. As a result, flow of the refrigerant in the crank chamber 140 to the suction chamber 141 is restricted, and the pressure of the crank chamber 140 is easily increased. Due to the increase in the pressure of the crank chamber 140, the inclination of the swash plate 111 is reduced from the maximum, making it possible to variably control the piston stroke.

In this way, the variable displacement compressor 100 is a compressor having the suction chamber 141, the compressing portion, the discharge chamber 142, and the crank chamber 140 as the control pressure chamber and undergoing a change in discharge capacity in response to the pressure of the crank chamber 140. In other words, it is a compressor controlled in discharge capacity through pressure control in the crank chamber 140.

Next, the first control valve 300, the check valve 350, and the second control valve 400 will be described in detail.

First Control Valve

Referring back to FIG. 2, the first control valve 300 is formed by a valve unit and a drive unit (solenoid) opening and closing the valve unit, and is accommodated in the accommodating hole 104*c* formed in the cylinder head 104.

The valve unit of the first control valve 300 has a cylindrical valve housing 301. Inside the valve housing 301, there are formed a first pressure sensing chamber 302, a valve chamber 303, and a second pressure sensing chamber 307 in that order in the axial direction.

The first pressure sensing chamber 302 communicates with the crank chamber 140 via a communication hole 301*a* formed in the outer peripheral surface of the valve housing 301, the third region S3 of the accommodating hole 104*c*, and the communication passage 104*d* formed in the cylinder head 104.

The second pressure sensing chamber 307 communicates with the suction chamber 141 via a communication hole 301*e* formed in the outer peripheral surface of the valve housing 301, the first region 51 of the accommodating hole 104*c*, and the communication passage 104*f* formed in the cylinder head 104. The valve chamber 303 communicates with the discharge chamber 142 via a communication hole 301*b* formed in the outer peripheral surface of the valve housing 301, the second region S2 of the accommodating hole 104*c*, and the communication passage 104*b* formed in the cylinder head 104. The first pressure sensing chamber 302 and the valve chamber 303 can communicate with each other via the valve hole 301*c*.

Between the valve chamber 303 and the second pressure sensing chamber 307, there is formed a support hole 301*d*. A bellows 305 is arranged in the first pressure sensing chamber 302. A vacuum is created inside the bellows 305, which contains a spring and is arranged so as to be capable of displacement in the axial direction of the valve housing 301, having a function as a pressure sensing means receiving the pressure in the first pressure sensing chamber 302, that is, the pressure in the crank chamber 140.

Inside the valve chamber 303, a columnar valve body 304 is accommodated. The valve body 304 has an outer peripheral surface in close contact with the inner peripheral surface of the support hole 301*d* and, in this state, can slide within the support hole 301*d*. It is movable in the axial direction of the valve housing 301. One end of the valve body 304 can open and close the valve hole 301*c*, and the other end of the valve body 304 protrudes into the second pressure sensing chamber 307. Fixed to one end of the valve body 304 is one end of a bar-like coupling portion 306. The coupling portion 306 has the other end arranged so as to be capable of abutting the bellows 305, and has a function by which it transmits displacement of the bellows 305 to the valve body 304.

The drive unit of the first control valve 300 has a cylindrical solenoid housing 312, and the solenoid housing 312 is coaxially coupled to the end portion of the valve housing 301. Accommodated in the solenoid housing 312 is a molded coil 314 having an electromagnetic coil covered with resin. Further, inside the solenoid housing 312, there is accommodated a cylindrical fixed core 310 coaxially with the molded coil 314, and the fixed core 310 extends from the valve housing 301 to the vicinity of the center of the molded coil 314. The end portion of a fixed core 310 on the side opposite the valve housing 301 is surrounded by a tubular sleeve 313. The fixed core 310 has at its center an insertion hole 310*a*, and one end of the insertion hole 310*a* is open to the second pressure sensing chamber 307. Between the fixed core 310 and the closed end of the sleeve 313, there is accommodated a cylindrical movable core 308.

A solenoid rod 309 is inserted into the insertion hole 310*a*, and one end of the solenoid rod 309 is fixed to the proximal end side of the valve body 304 through forcing-in. The other end portion of the solenoid rod 309 is forced into a through-hole formed in the movable core 308, and the solenoid rod 309 and the movable core 308 are integrated with each other. Provided between the fixed core 310 and the movable core 308 is a release spring 311 urging the movable core 308 away from the fixed core 310 (in the valve opening direction).

The movable core 308, the fixed core 310, and the solenoid housing 312 are formed of a magnetic material, and form a magnetic circuit. The sleeve 313 is formed of a non-magnetic material such as a stainless steel type material. The molded coil 314 is connected to a control device provided outside the variable displacement compressor 100 via a signal line. When a control electric current I is supplied from the control device, the molded coil 314 generates an electromagnetic force F(i). The electromagnetic force F(i) of the molded coil 314 attracts the movable core 308 toward the fixed core 310, and drives the valve body 304 in the valve closing direction.

Apart from the electromagnetic force F(i) due to the molded coil 314, an urging force fs due to the release spring 311, a force due to the pressure of the valve chamber 303 (discharge chamber pressure Pd), a force due to the pressure of the first pressure sensing chamber 302 (crank chamber pressure Pc), a force due to the pressure of the second pressure sensing chamber 307 (suction chamber pressure Ps), and an urging force F due to the spring contained in the bellows 305 act on the valve body 304 of the first control valve 300.

Here, the effective pressure receiving area Sb in the expanding/contracting direction of the bellows 305 is Sb, the pressure receiving area of the crank chamber acting on the valve body 304 from the valve hole 301*c* side is Sv, and the sectional area of the cylindrical outer peripheral surface of the valve body 304 is Sr=Sb=Sv, so that the relationship between the forces acting on the valve body 304 is expressed by formula 1. In formula 1, "+" indicates the valve closing direction of the valve body 304, and "−" indicates the valve opening direction thereof.

$$Ps = -\frac{1}{Sb} \cdot F(i) + \frac{F+f}{Sb} \quad \text{[Formula 1]}$$

When the suction chamber pressure Ps becomes higher than a set pressure, the coupled body of the bellows 305, the coupling portion 306, and the valve body 304 reduces the opening degree of the supply passage 145 to thereby reduce the crank chamber pressure Pc in order to increase the discharge capacity, and when the suction chamber pressure Ps becomes lower than the set pressure, the coupled body increases the opening degree of the supply passage 145 to thereby increase the crank chamber pressure Pc in order to reduce the discharge capacity. That is, the first control valve 300 autonomously controls the opening degree (opening area) of the supply passage 145 such that the suction chamber pressure Ps approaches the set pressure.

Figure 6:
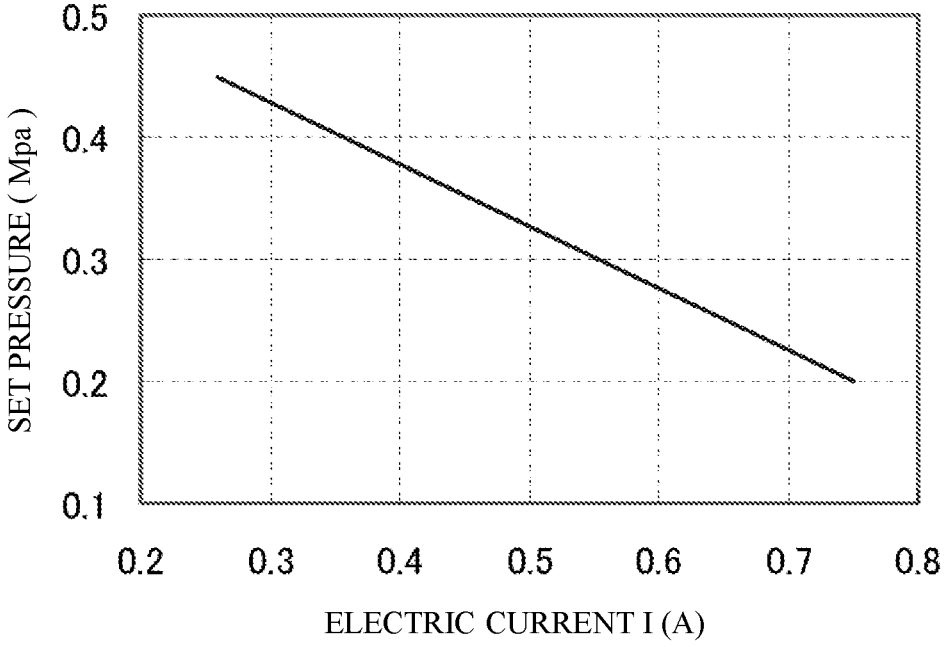
FIG. 6 is a chart illustrating the relationship between the coil electricity supply amount and the set pressure of the first control valve.

FIG. 6 is a chart illustrating the relationship between the coil electricity supply amount of the first control valve 300 and the set pressure. The electromagnetic force of the molded coil 314 acts on the valve body 304 in the valve closing direction via the solenoid rod 309, so that when the electricity supply amount to the molded coil 314 increases, the force in the direction in which the opening degree of the supply passage 145 is reduced increases, and the set pressure is changed in the reducing direction as illustrated in FIG. 6. The control device (drive unit) controls the electricity supply to the molded coil 314 through pulse width modulation (PWM control) at a predetermined frequency in the range, for example, of 400 Hz to 500 Hz, and changes the pulse width (duty ratio) such that the value of the electric current flowing through the molded coil 314 attains a desired value.

During the operation of the air conditioning system, that is, in the operating state of the variable displacement compressor 100, the electricity supply amount to the molded coil 314 is adjusted by the control device based on the air conditioning setting such as the set temperature and the external environment, and the discharge capacity is controlled such that the suction chamber pressure Ps attains a set pressure corresponding to the electricity supply amount. When the air conditioning system is not operating, that is, in the non-operating state of the variable displacement compressor 100, the control device turns OFF the electricity supply to the molded coil 314. As a result, the supply passage 145 is opened by the release spring 311, and the discharge capacity of the variable displacement compressor 100 is controlled to a minimum.

Check Valve

Figure 7A:
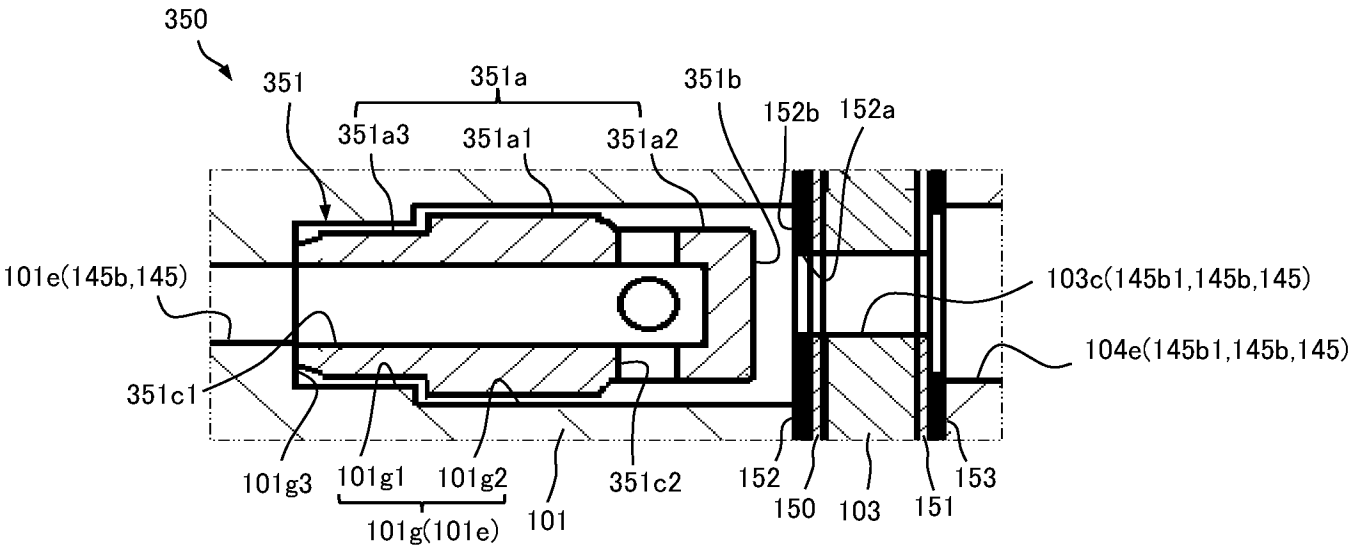
FIGS. 7A and 7B are enlarged partial sectional views each including the check valve of the variable displacement compressor.
Figure 7B:
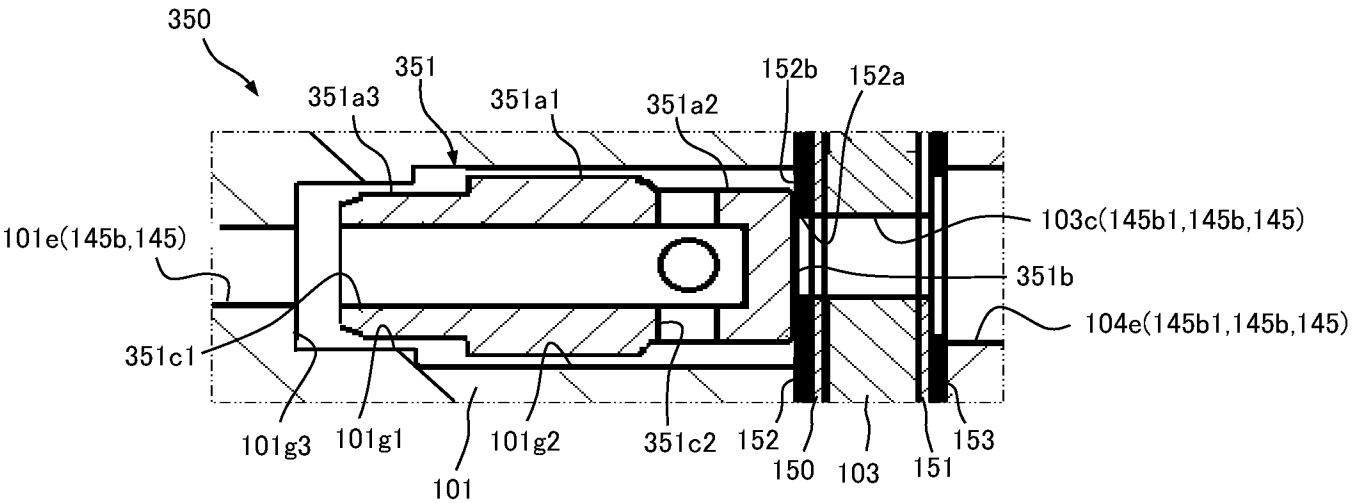

Next, the check valve 350 will be described with reference to FIGS. 7A and 7B. FIGS. 7A and 7B are enlarged partial sectional views of the variable displacement compressor 100 including the check valve 350. FIG. 7A illustrates the state in which the check valve 350 operates so as to allow flow of the refrigerant from the first control valve 300 toward the crank chamber 140, and FIG. 7B illustrates the state in which the check valve 350 operates so as to prevent backflow of the refrigerant from the crank chamber 140 toward the first control valve 300.

The check valve 350 is equipped with a valve body 351, an accommodating hole 101*g* accommodating the valve body 351, a valve hole 152*a* closing one end of the accommodating hole 101*g*, and a cylinder gasket 152 as a valve seat forming member having a valve seat 152*b*. That is, the valve hole 152*a* and the valve seat 152*b* are formed in the cylinder gasket 152.

The valve body 351 is equipped with a substantially cylindrical peripheral wall 351*a* and an end wall 351*b* connected to one end of the peripheral wall 351*a*. The peripheral wall 351*a* includes a large diameter portion 351*a*1 constituting the intermediate portion in the longitudinal direction of the valve body, a first small diameter portion 351*a*2 connecting between the large diameter portion 351*a*1 and the end wall 351*b* and having a diameter smaller than that of the large diameter portion 351*a*1, and a second small diameter portion 351*a*3 extending from the end surface of the large diameter portion 351*a*1 on the side opposite the first small diameter portion 351*a*2 and having a diameter smaller than that of the large diameter portion 351*a*1. An inner passage is formed in the valve body 351. This inner passage is formed by a first passage 351*c*1 formed from the open end of the peripheral wall 351*a* toward the end wall 351*b*, and a second passage 351*c*2 extending through the peripheral wall of the first small diameter portion 351*a*2 and establishing communication between the first passage 351*c*1 and the accommodating hole 101*g* around the first small diameter portion 351*a*2. The valve body 351 formed, for example, of a resin material. It may also be formed of some other material such as a metal material.

The accommodating hole 101*g* is formed at the opening end portion on the valve plate 103 side of the communication passage 101*e* of the cylinder block 101, and forms a part of the communication passage 101*e*. The accommodating hole 101*g* is formed by a small diameter portion 101*g*1 on the crank chamber 140 side and a large diameter portion 101*g*2 on the valve plate 103 side which is of a larger diameter than the small diameter portion 101*g*1. The large diameter portion 351*a*1 of the valve body 351 is slidably supported by the large diameter portion 101*g*2, and the second small diameter portion 351*a*3 of the valve body 351 is slidably supported by the small diameter portion 101*g*1.

The accommodating hole 101*g* is formed so as to be orthogonal to the end surface of the cylinder block 101, and the valve body 351 moves in the extending direction of the axis O of the drive shaft 110. The end wall 351*b* of the valve body 351 abuts the valve seat 152*b*, whereby movement in one direction of the valve body 351 is regulated, and the other end of the peripheral wall 351*a* abuts the end surface 101*g*3 of the accommodating hole 101*g*, whereby movement in the other direction of the valve body 351 is regulated. When the end wall 351*b* abuts the valve seat 152*b*, the valve hole 152*a* is closed, and when the end wall 351*b* is separated from the valve seat 152*b*, the valve hole 152*a* is opened.

The accommodating hole 101*g* communicates with the third region S3 of the accommodating hole 104*c* of the first control valve 300 via the intermediate supply passage 145*b*1 of the downstream side supply passage 145*b* between the first control valve 300 and the check valve 350. The communication passage 101*e* extends through the end surface on the front housing 102 side of the cylinder block 101 to extend to the cylinder head 104 side, and, at the same time, extends through the end surface 101*g*3 of the accommodating hole 101*g* to be open in the cylinder head 104 side end surface via the accommodating hole 101*g*.

Thus, the pressure Pm of the intermediate supply passage 145*b*1 (the pressure on the upstream side of the check valve 350) acts on one end of the valve body 351, and the pressure Pc of the crank chamber (the pressure on the downstream side of the check valve 350) acts on the other end of the valve body 351, with the valve body 351 moving in the axial direction in response to the pressure difference between the upstream and downstream sides (Pm−Pc) acting on the valve body 351.

The intermediate supply passage 145*b*1 communicates with the suction chamber 141 via a back-pressure relief passage 147, and this back-pressure relief passage 147 is provided with a throttle portion 147*a*. Thus, in the state in which the first control valve 300 opens the valve hole 301*c*, the major portion of the refrigerant gas of the discharge chamber 142 reaches the valve hole 152*a* of the check valve 350 via the communication passage 104*d*, the connection portion 104*e*, the communication hole of the head gasket 153, the communication hole of the discharge valve forming plate 151, the communication hole 103*c*, and the communication hole of the suction valve forming plate 150. As a result, the pressure Pm of the intermediate supply passage 145*b*1 acting on one end of the valve body 351 increases, so that Pm−Pc>0. Due to the pressure difference (Pm−Pc) between the upstream and downstream sides acting on the valve body 351, the end wall 351*b* of the valve body 351 is separated from the valve seat 152*b*, and the other end of the peripheral wall 351*a* abuts the end surface 101*g*3 of the accommodating hole 101*g*. As a result, the refrigerant gas of the discharge chamber 142 is supplied to the crank chamber 140 from the valve hole 152*a* via the large diameter portion 101*g*2 of the accommodating hole 101*g*, the second passage 351*c*2, the first passage 351*c*1, and the communication passage 101*e* on the downstream side of the check valve 350.

When, in the state in which the first control valve 300 opens the valve hole 301*c*, the valve hole 301*c* is closed, the refrigerant gas of the discharge chamber 142 is not supplied to the intermediate supply passage 145*b*1, and the refrigerant gas of the intermediate supply passage 145*b*1 flows to the suction chamber 141 via the back-pressure relief passage 147. As a result, the pressure Pm of the intermediate supply passage 145*b*1 acting on one end of the valve body 351 is reduced, so that Pm−Pc<0. Then, due to the pressure difference (Pm−Pc) between the upstream and downstream sides acting on the valve body 351, the other end of the peripheral wall 351*a* is separated from the end surface 101*g*3 of the accommodating hole 101*g*, and the end wall 351*b* of the valve body 351 abuts the valve seat 152*b*, with the communication between the downstream communication passage 101*e* and the intermediate supply passage 145*b*1 being cut off by the check valve 350. As a result, the pressure Pm of the intermediate supply passage 145*b*1 is equivalent to the suction chamber pressure Ps. In this way, the check valve 350 opens and closes the supply passage 145 in conjunction with the opening and closing of the first control valve 300.

An urging means such as a compression coil spring urging the valve body 351 toward the valve seat 152*b* may be added to the check valve 350. Further, the valve seat forming member is not restricted to the cylinder gasket 152. For example, it may be a suction valve forming plate 150 or the valve plate 103.

Second Control Valve

Figure 8:
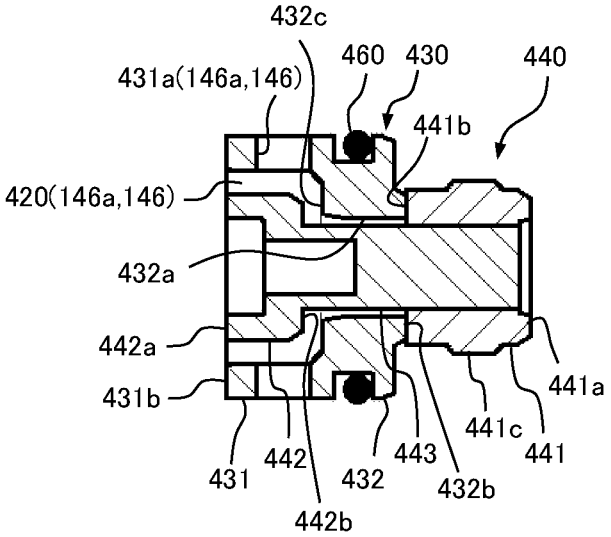
FIG. 8 is a sectional view of the second control valve of the variable displacement compressor.
Figure 9:
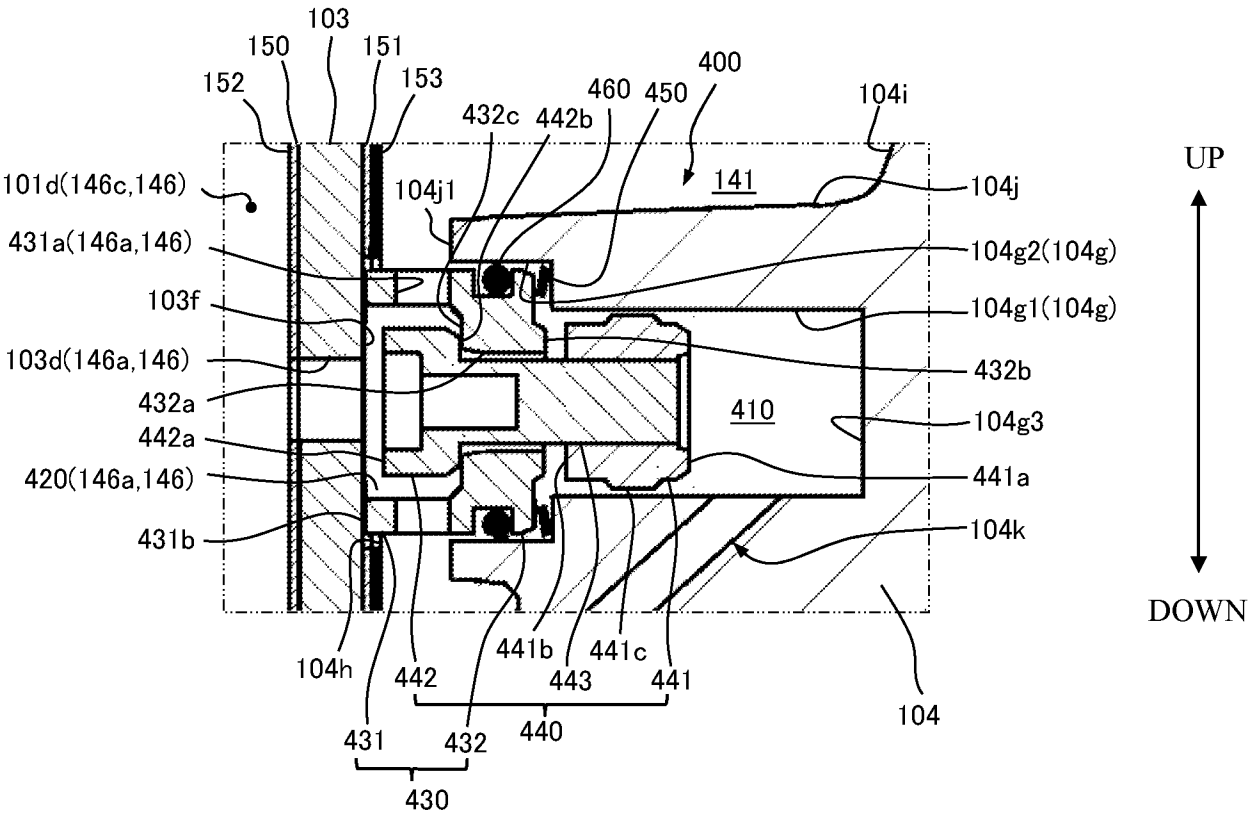
FIG. 9 is a sectional view illustrating a state in which the valve seat side end surface of the valve portion of the second control valve is spaced way from the valve seat to a maximum.

The second control valve 400 will be described with reference to FIGS. 1 through 3, FIG. 8, and FIG. 9. FIG. 8 is a sectional view of the second control valve 400, and FIG. 9 is a sectional view illustrating a state in which a valve seat side end surface 442*a* of a valve portion, described below, of the second control valve 400 is spaced away from the valve seat 103*f* to a maximum.

The second control valve 400 has a back-pressure chamber 410, a valve chamber 420, a dividing member 430, and the spool 440 having a circular sectional configuration and extending in one direction, and is accommodated in the accommodating hole 104*g* formed in the cylinder head 104 and open to the suction chamber 141.

As illustrated in FIG. 3, the accommodating hole 104*g* is formed so as to be open on the connection end surface 104*h* side connected to the cylinder block 101 (head gasket 153) of the cylinder head 104. More specifically, the accommodating hole 104*g* is formed in a stepped columnar configuration on a protrusion 104*j* protruding toward the valve plate 103 from the closed end wall 104*i* of the suction chamber forming wall of the cylinder head 104. More specifically, this protrusion 104*j* is arranged in the extension of the axis O of the drive shaft 110, and is situated at the central portion in the radial direction of the suction chamber 141. The protrusion 104*j* extends from the closed end wall 104*i* of the cylinder head 104 to a position in front of the connection end surface 104*h* so as to leave a gap between itself and the head gasket 153. The accommodating hole 104*g* has the center axis thereof substantially matched with the axis O of the drive shaft 110, and has a large diameter portion on the connection end surface 104*h* side of the cylinder head 104, a small diameter portion of a smaller diameter than the large diameter portion on the depth side, and a stepped portion between the large diameter portion and the small diameter portion. The small diameter portion constitutes a first accommodating chamber 104*g*1, and the large diameter portion constitutes a second accommodating chamber 104*g*2 accommodating the dividing member 430.

The back-pressure chamber 410 communicates with the intermediate supply passage 145*b*1 via the communication passage 104*k* connected to the back-pressure chamber 410 and the intermediate supply passage 145*b*1. Thus, the pressure in the back-pressure chamber 410 is equivalent to the pressure Pm of the intermediate supply passage 145*b*1. In the present embodiment, the back-pressure chamber 410 consists of the first accommodating chamber 104*g*1 defined by the dividing member 430. The communication passage 104*k* will be described in detail below.

Opened to the valve chamber 420 are the valve hole 103*d* communicating with the upstream side discharge passage 146*c* (See FIG. 2 and FIG. 3) of the discharge passage 146 between the second control valve 400 and the crank chamber 140, and the discharge hole 431*a* communicating with the suction chamber 141, and the valve chamber 420 constitutes a part of the discharge passage 146 (more specifically, the first discharge passage 146*a*). In the present embodiment, the discharge hole 431*a* is formed in a peripheral wall 431, described below, of the dividing member 430, and the valve hole 103*d* is formed in the valve plate 103.

The dividing member 430 is a member dividing the back-pressure chamber 410 and the valve chamber 420 from each other, and has, for example, a cylindrical peripheral wall 431 and a disc-like end wall 432. The peripheral wall 431 is provided so as to surround a valve portion 442, described below, of the spool 440. The end wall 432 is connected to one end side of the peripheral wall 431. The end wall 432 has a through-hole 432*a* for inserting a shaft portion 443, described below, of the spool 440. The first accommodating chamber 104*g*1 defined by the end wall 432 forms the back-pressure chamber 410, and the cylindrical space on the inner side of the dividing member 430 defined by the peripheral wall 431 and the end wall 432 forms the valve chamber 420. In other words, the inner space surrounded by the peripheral wall 431 of the dividing member 430 defines the valve chamber 420.

In the present embodiment, the outer diameter of the peripheral wall 431 of the dividing member 430 is set to be smaller than the inner diameter of the peripheral wall of the second accommodating chamber 104*g*2, and the peripheral wall 431 is slidably supported by the peripheral wall of the second accommodating chamber 104*g*2. In the present embodiment, arranged on the connection end surface between the outer edge portion in the radial direction on the pressure receiving portion side end surface 432*b* side of the end wall 432 of the dividing member 430 and the second accommodating chamber 104*g*2 and the first accommodating chamber 104*g*1 (in other words, the step portion between the large diameter portion and the small diameter portion of the accommodating hole 104*g*) is a Belleville spring 450 as an urging means urging the dividing member 430. In order to prevent the refrigerant having that flowed in from the first accommodating chamber 104*g*1 from flowing out into the suction chamber 141 via the gap on the outer side of the peripheral wall 431, an O-ring 460 is arranged between the peripheral wall 431 and the second accommodating chamber 104*g*2.

In the present embodiment, the dividing member 430 is set in position within the second accommodating chamber 104*g*2 such that by being urged toward the valve plate 103 by the Belleville spring 450 in the state in which it is accommodated in the second accommodating chamber 104*g*2, the end surface 431*b* on the side opposite the end wall 432 of the peripheral wall 431 abuts the valve plate 103 constituting the wall surface on the side opposite the back-pressure chamber 410 of the valve chamber 420. In this state, in the dividing member 430, the end surface 431*b* on the side opposite the end wall 432 of the peripheral wall 431 protrudes further to the valve plate 103 side than the protrusion end surface 104*j*1 of the protrusion 104*j*.

Discharge holes 431*a* open to the valve chamber 420 extend through the peripheral wall 431 at a plurality of positions at intervals in the peripheral direction of the peripheral wall 431. Via the discharge holes 431*a*, the valve chamber 420 communicates with the suction chamber 141. More specifically, the portion of the peripheral wall 431 on the end surface 431*b* side protrudes from the protrusion end surface 104*j*1 of the protrusion 104*j* to the valve plate 103 side such that the discharge holes 431*a* directly open to the suction chamber 141. The discharge holes 431*a* are not restricted to holes. They may also be formed as cutouts.

The valve hole 103*d* open to the valve chamber 420 is formed in the valve plate 103 closing the open end of the dividing member 430. The portion of the valve plate 103 around the valve hole 103*d* constitutes the valve seat 103*f* to and away from which the valve portion 442, described below, of the spool 440 moves. The valve chamber 420 communicates with the crank chamber 140 via the valve hole 103*d*, the communication hole of the suction valve forming plate 150, the communication hole of the cylinder gasket 152, the space 101*d*, and the communication passage 101*c*. That is, in the present embodiment, the upstream side discharge passage 146*c* of the discharge passage 146 is formed by the communication hole of the suction valve forming plate 150, the communication hole of the cylinder gasket 152, the space 101*d*, and the communication passage 101*c*. The upstream side discharge passage 146*c* communicates with the valve chamber 420 via the valve hole 103*d*.

The spool 440 has a circular sectional configuration and is formed so as to extend in one direction. The spool 440 has a pressure receiving portion 441, a valve portion 442, and a shaft portion 443. Each of the pressure receiving portion 441, the valve portion 442, and the shaft portion 443 has a circular sectional configuration.

The pressure receiving portion 441 is arranged inside the back-pressure chamber 410, and is a member receiving the back-pressure Pm. More specifically, the pressure receiving portion 441 is accommodated in the first accommodating chamber 104*g*1, and is slidably supported by the first accommodating chamber 104*g*1. The pressure receiving portion 441 has a pressure receiving end surface 441*a* facing the hole bottom surface 104*g*3 (See FIGS. 3 and 9) of the accommodating hole 104*g*, and a dividing member side end surface 441*b* facing the dividing member 430 (more specifically, the pressure receiving portion side end surface 432*b*).

The valve portion 442 is arranged inside the valve chamber 420, and is a member moving to and away from the valve seat 103*f* around the valve hole 103*d*. As illustrated in FIG. 8, the valve portion 442 has a valve seat side end surface 442*a* facing the valve seat 103*f*, and an end wall side end surface 442*b* facing the end wall 432 of the dividing member 430. The valve portion 442 is accommodated in the valve chamber 420, and the valve seat side end surface 442*a* moves to and away from the valve seat 103*f* to open and close the valve hole 103*d*.

The shaft portion 443 is a member connecting the pressure receiving portion 441 and the valve portion 442, and is formed so as to extend through a through-hole 432*a* (See FIGS. 8 and 9) formed in the end wall 432 of the dividing member 430. The shaft portion 443 has an outer diameter smaller than the outer diameters of the pressure receiving portion 441 and the valve portion 442.

In the present embodiment, the shaft portion 443 is formed integrally with the valve portion 442. In a state in which the shaft portion 443 is inserted into the through-hole 432*a* of the dividing member 430, the pressure receiving portion 441 is forced into the shaft portion 443, whereby the spool 440 is formed.

Here, in a state in which the first control valve 300 closes the supply passage 145 and in which the valve seat side end surface 442*a* of the valve portion 442 is spaced away from the valve seat 103*f* to a maximum, the end wall side end surface 442*b* abuts the end wall 432 as illustrated in FIG. 9. That is, the valve portion side end surface 432*c* facing the valve portion 442 of the end wall 432 (more specifically, the end wall side end surface 442*d*) constitutes a regulation surface regulating the maximum lift amount of the valve portion 442 from the valve seat 103*f* More specifically, the length of the pressure receiving portion 441 is set such that when the spool 440 moves away from the valve seat 103*f*, the end wall side end surface 442*b* of the valve portion 442 abuts the valve portion side end surface 432*c* of the valve portion 442 before the pressure receiving end surface 441*a* of the pressure receiving portion 441 abuts the hole bottom surface 104*g*3 of the accommodating hole 104*g*.

In the present embodiment, when the first control valve 300 opens the supply passage 145 and the valve portion 442 abuts the valve seat 103*f*, the pressure receiving portion 441 abuts the end wall 432 of the dividing member 430 as illustrated in FIGS. 3 and 8. More specifically, the forcing-in position in the axial direction of the pressure receiving portion 441 with respect to the valve portion 442 and the shaft portion 443 is adjusted such that when the valve seat side end surface 442*a* of the valve portion 442 abuts the valve seat 103*f*, the dividing member side end surface 441*b* of the pressure receiving portion 441 facing the dividing member 430 simultaneously abuts the pressure receiving portion side end surface 432*b* of the end wall 432 facing the pressure receiving portion 441.

Next, the operation of the spool 440 of the second control valve 400 will be described.

The second control valve 400 is formed such that it moves the spool 440 in response to the pressure in the back-pressure chamber 410 (hereinafter referred to as the back-pressure) and the pressure in the upstream side discharge passage 146*c* (that is, the crank chamber pressure Pc) to cause the valve portion 442 to move to and away from the valve seat 103*f*, thereby controlling the opening degree of the discharge passage 146. As stated above, the back-pressure chamber 410 communicates with the intermediate supply passage 145*b*1 via the communication passage 104*k*, so that the pressure in the back-pressure chamber 410 (back-pressure) is equivalent to the pressure Pm of the intermediate supply passage 145*b*1. Further, the pressure in the upstream side discharge passage 146*c* is equivalent to the crank chamber pressure Pc. Thus, the second control valve 400 operates the spool 440 in response to the back-pressure (the pressure of the intermediate supply passage 145*b*1) Pm and the crank chamber pressure Pc.

One end surface of the spool 440 (the pressure receiving end surface 441*a* of the pressure receiving portion 441) receives the back-pressure Pm, and the other end surface of the spool 440 (the valve seat side end surface 442*a* of the valve portion 442) receives the crank chamber pressure Pc, so that the spool 440 moves in the axial direction in response to the pressure difference (Pm−Pc). When Pm−Pc>0, the other end surface of the spool 440 abuts the valve seat 103*f*, and the second control valve 400 closes the first discharge passage 146*a*. When Pm−Pc<0, the valve portion 442 abuts the end wall 432 of the dividing member 430, and the second control valve 400 opens the first discharge passage 146*a* to a maximum. The pressure receiving area A1 of the spool 440 in the axial direction receiving the back-pressure Pm and the pressure receiving area A2 of the spool 440 receiving the crank chamber pressure Pc are set, for example, such that A1=A2. To adjust the operation of the spool 440, however, they may be set such that A1>A2 or that A1<A2.

More specifically, in the second control valve 400, when the force in the valve closing direction moving the spool 440 toward the valve seat 103*f* due to the pressure (back-pressure Pm) acting on the pressure receiving portion 441 becomes larger than the force in the valve opening direction moving the spool 440 away from the valve seat 103*f* due to the pressure acting on the valve portion 442, the valve portion 442 abuts the valve seat 103*f*, thereby cutting off the communication between the valve hole 103*d* and the discharge hole 431*a* to minimize the opening degree of the discharge passage 146, and when the force in the valve closing direction becomes smaller than the force in the valve opening direction, the valve portion 442 is separated from the valve seat 103*f*, thereby establishing communication between the valve hole 103*d* and the discharge hole 431*a* to maximize the opening degree of the discharge passage 146.

Here, between the outer peripheral surface of the shaft portion 443 and the inner peripheral surface of the through-hole 432*a*, there is a minute gap so that the spool 440 can move. Thus, in the state in which the first control valve 300 closes the supply passage 145 and in which the valve seat side end surface 442*a* of the valve portion 442 begins to slightly separate from the valve seat 103*f*, a portion of the refrigerant gas having flowed into the valve chamber 420 from the crank chamber 140 via the valve hole 103*d* flows to the back-pressure chamber 410 via the gap between the end wall side end surface 442*b* of the valve portion 442 and the end wall 432 (more specifically, the valve portion side end surface 432*c*), as illustrated in FIG. 9 and via the gap between the outer peripheral surface of the shaft portion 443 and the inner peripheral surface of the through-hole 432*a*. On the other hand, in the state in which the first control valve 300 closes the supply passage 145 and in which the valve seat side end surface 442*a* of the valve portion 442 is spaced away from the valve seat 103*f* to a maximum, the end wall side end surface 442*b* of the valve portion 442 abuts the end wall 432 (more specifically, the valve portion side end surface 432*c*), so that the flow of refrigerant from the valve chamber 420 to the back-pressure chamber 410 via the gap between the outer peripheral surface of the shaft portion 443 and the inner peripheral surface of the through-hole 432*a* is cut off. Thus, the end wall side end surface 442*b* of the valve portion 442 and the valve portion side end surface 432*c* of the end wall 432 constitute a valve means.

Further, in the present embodiment, a minute gap is formed between the outermost peripheral surface 441*c* of the pressure receiving portion 441 slidably supported by the inner peripheral surface of the first accommodating chamber 104*g*1 and the inner peripheral surface of the first accommodating chamber 104*g*1. As a result, in the state in which the first control valve 300 opens the supply passage 145 and in which the end wall side end surface 442*b* of the valve portion 442 begins to slightly separate from the valve portion side end surface 432*c* of the end wall 432, the refrigerant gas having flowed into the back-pressure chamber 410 (the first accommodating chamber 104*g*1) from the communication passage 104*k* flows to the valve chamber 420 via the gap between the outermost peripheral surface 441*c* and the inner peripheral surface of the first accommodating chamber 104*g*1 and via the gap between the outer peripheral surface of the shaft portion 443 and the inner peripheral surface of the through-hole 432*a*. On the other hand, when the first control valve 300 opens the supply passage 145, and the valve seat side end surface 442*a* of the valve portion 442 abuts the valve seat 103*f*, the dividing member side end surface 441*b* of the pressure receiving portion 441 abuts the pressure receiving portion side end surface 432*b* of the end wall 432, so that the refrigerant flow from the back-pressure chamber 410 to the valve chamber 420 via the gap between the outer peripheral surface of the shaft portion 443 and the inner peripheral surface of the through-hole 432*a* is cut off Thus, the dividing member side end surface 441*b* of the pressure receiving portion 441 and the pressure receiving portion side end surface 432*b* of the end wall 432 constitute a valve means.

In the state in which the valve portion 442 is in contact with the valve seat 103*f*, the refrigerant gas in the intermediate supply passage 145*b*1 flows slightly into the suction chamber 141 via the back-pressure relief passage 147. As illustrated in FIG. 5, in the present embodiment, the back-pressure relief passage 147 is open to the suction chamber 141 via the throttle portion 147*a* formed in the discharge valve forming plate 151 and the communication hole of the head gasket 153. More specifically, the back-pressure relief passage 147 is formed so as to establish communication between the connection portion 104*e*1 of the intermediate supply passage 145*b*1 and the suction chamber 141 via a passage formed in the interposed objects (discharge valve forming plate 151 and the head gasket 153) between the cylinder block 101 and the cylinder head 104. In this way, in the present embodiment, the back-pressure relief passage 147 is formed so as to bypass the second control valve 400 and to establish direct communication between the connection portion 104*e* of the intermediate supply passage 145*b*1 and the suction chamber 141.

Communication Passage

Next, the communication passage 104*k* establishing communication between the back-pressure chamber 410 and the intermediate supply passage 145*b*1 will be described in detail.

In the present embodiment, one end of the communication passage 104*k* is connected to the connection portion 104*e* provided at some midpoint of the intermediate supply passage 145*b*1, and the other end of the communication passage 104*k* is connected to the back-pressure chamber 410. Of the communication passage 104*k*, at least the communication passage side connection portion 104*k*1 (See FIG. 3) extending from the connection portion 104*e* toward the back-pressure chamber 410 extends at an acute angle with respect to the communication passage 104*d* as the intermediate supply passage side connection portion extending from the connection portion 104*e* toward the first control valve 300 in the intermediate supply passage 145*b*1. That is, the communication passage 104*k* as the intermediate supply passage side connection portion branches off from the connection portion 104*e* of the intermediate supply passage 145*b*1 so as to turn back opposite the mainstream direction of the refrigerant flowing through the intermediate supply passage 145*b*1 from the first control valve 300 toward the check valve 350. The communication passage side connection portion 104*k*1 is a passage portion in the vicinity of the connection portion 104*e* of the communication passage 104*k*.

In the present embodiment, the communication passage 104*k* extends over the entire length of the communication passage at an acute angle with respect to the communication passage 104*d* as the intermediate supply passage side connection portion. That is, the communication passage 104*k* extends, over the entire length of the communication passage, in one direction opposite the mainstream direction of the refrigerant flowing through the intermediate supply passage 145*b*1 from the first control valve 300 toward the check valve 350. Thus, it forms a V-shaped passage with the communication passage 104*d* extending linearly in one direction with respect to the communication passage 104*k*.

In the present embodiment, the communication passage 104*k* is formed such that the back-pressure chamber side opening end thereof opens in the lower side portion in the gravitational direction of the inner wall surface of the back-pressure chamber 410 in the state in which the compressor is installed.

In the present embodiment, the connection portion 104*e* of the intermediate supply passage 145*b*1 is arranged so as to be situated on the lower side in the gravitational direction of the second control valve 400 in the state in which the compressor is installed. The connection portion 104*e* is arranged on the valve plate 103 side of the back-pressure chamber 410. Thus, the communication passage 104*k* turns back from the connection portion 104*e* and extends obliquely upwards to open to the back-pressure chamber 410.

In the present embodiment, the first control valve 300 and the second control valve 400 are arranged inside the cylinder head 104 at positions mutually deviated in a direction orthogonal to the extending direction of the axis O of the drive shaft 110 (that is, the center axis extending direction of the compressor housing). More specifically, the first control valve 300 is arranged vertically downwards with respect to the second control valve 400. Thus, the connection portion 104*e*, the communication passage 104*d* of the intermediate supply passage side connection portion, and the second control valve 400 are collectively arranged below the second control valve 400. Further, the second control valve 400 is arranged such that the center axis thereof substantially coincides with the axis O of the drive shaft 110. On the other hand, the first control valve 300 is arranged such that the center axis thereof extends in the horizontal direction and that the center axis thereof is orthogonal to the axis O of the drive shaft 110.

Operation of Variable Displacement Compressor

Here, the operation of the variable displacement compressor 100 will be described.

When, in the state in which the variable displacement compressor 100 is being operated, the electricity supply to the molded coil 314 of the first control valve 300 is cut off, the first control valve 300 is opened to a maximum. As a result, the back-pressure Pm increases, so that in the case in which the check valve 350 closes the supply passage 145 (at the time of maximum discharge capacity), the check valve 350 opens the supply passage 145 and, at the same time, the second control valve 400 closes the first discharge passage 146*a*. As a result, the discharge passage 146 is the second discharge passage 146*b* only, and the pressure of the crank chamber 140 increases and the inclination of the swash plate 111 decreases, maintaining the discharge capacity at a minimum.

Substantially simultaneously with this, the discharge check valve 200 cuts off the discharge passage, and the refrigerant gas discharged at the minimum discharge capacity does not flow to the external refrigerant circuit but circulates through an internal circulation passage formed by the discharge chamber 142, the supply passage 145, the crank chamber 140, the second discharge passage 146*b*, the suction chamber 141, and the cylinder bore 101*a*. In this state, the refrigerant gas in the region of the supply passage 145 between the first control valve 300 and the check valve 350, that is, the refrigerant gas in the intermediate supply passage 145*b*1 slightly flows out into the suction chamber 141 via the back-pressure relief passage 147 provided so as to bypass the second control valve 400.

When in this state electricity is supplied to the molded coil 314 of the first control valve 300, the first control valve 300 is closed to close the supply passage 145, and the refrigerant gas in the intermediate supply passage 145*b*1 flows out into the suction chamber 141 via the back-pressure relief passage 147. Then, the pressure of the intermediate supply passage 145*b*1 (back-pressure Pm) is reduced, and the check valve 350 closes the supply passage 145, preventing backflow of the refrigerant gas to the supply passage 145 upstream of the check valve 350. At the same time, the second control valve 400 opens the first discharge passage 146*a*.

Thus, at this time, the discharge passage 146 is formed by the first discharge passage 146*a* and the second discharge passage 146*b*.

The flow passage sectional area in the second control valve 400 is set to be larger than the flow passage sectional area of the groove portion 150*a* as the fixed throttle, and the refrigerant in the crank chamber 140 quickly flows out into the suction chamber 141 to reduce the pressure of the crank chamber 140, with the discharge capacity increasing from the minimum state to the maximum discharge capacity. As a result, the pressure of the discharge chamber 142 increases abruptly to open the discharge check valve 200, and the refrigerant circulates through the external refrigerant circuit to place the air conditioning system in the operating state.

When the air conditioning system operates and the pressure of the suction chamber 141 is reduced and the set pressure set by the electric current flowing through the molded coil 314 is reached, the first control valve 300 is opened. As a result, the back-pressure Pm is increased, whereby the check valve 350 opens the supply passage 145 and, at the same time, the second control valve 400 closes the first discharge passage 146*a*. Thus, at this time, the discharge passage 146 is the second discharge passage 146*b* alone. As a result, the inflow of the refrigerant of the crank chamber 140 into the suction chamber 141 is restricted, and the pressure of the crank chamber 140 is easily increased. Then, the opening degree of the first control valve 300 is adjusted such that the pressure of the suction chamber 141 maintains the set pressure, and the discharge capacity is variably controlled.

In the variable displacement compressor 100 of the present embodiment, in the second control valve 400, the end wall side end surface 442*b* of the valve portion 442 abuts the end wall 432 (the valve portion side end surface 432*c*) in the state in which the first control valve 300 closes the supply passage 145 and in which the valve seat side end surface 442*a* of the valve portion 442 is spaced away from the valve seat 103*f* to a maximum, whereby the communication between the valve chamber 420 and the back-pressure chamber 410 via the through-hole 432*a* is cut off. As a result, even when the first control valve 300 closes the supply passage 145, and minute foreign matter circulates through the discharge passage 146 along with the refrigerant to flow into the valve chamber 420, all or the major portion of the foreign matter flows to the suction chamber 141 via the open discharge passage 146 along with the refrigerant. As a result, it is possible to prevent or suppress intrusion of foreign matter into the back-pressure chamber 410. Thus, even when minute foreign matter is circulating along with the refrigerant, it is possible to operate the spool 440 in a satisfactory manner. In this way, it is possible to provide a variable displacement compressor 100 capable of preventing or suppressing intrusion of foreign matter into the second control valve 400.

In the present embodiment, the check valve 350 is provided in the downstream side supply passage 145*b* of the supply passage 145 between the first control valve 300 and the crank chamber 140, and the back-pressure chamber 410 of the second control valve 400 communicates with the intermediate supply passage 145*b*1 of the downstream side supply passage 145*b* between the first control valve 300 and the check valve 350 via the communication passage 104*k*. Of this communication passage 104*k*, at least the communication passage side connection portion 104*k*1 extending from the connection portion 104*e* toward the back-pressure chamber 410 extends at an acute angle with respect to the communication passage 104*d* as the intermediate supply passage side connection portion extending from the connection portion 104*e* toward the first control valve 300 in the intermediate supply passage 145*b*1. As a result, even when the first control valve 300 opens the supply passage 145, and minute foreign matter circulates through the intermediate supply passage 145*b*1 along with the refrigerant, all or the major portion of the foreign matter flows along the mainstream flow of the refrigerant flowing in the connection portion 104*e* from the first control valve 300 toward the check valve 350. As a result, it is possible to prevent or suppress intrusion of foreign matter into the back-pressure chamber 410. Thus, even when the first control valve 300 opens the supply passage 145, it is possible to prevent or suppress intrusion of foreign matter into the second control valve 400. In other words, in the present embodiment, in addition to the intrusion of foreign matter from the valve chamber 420 into the back-pressure chamber 410, it is possible to prevent or suppress intrusion of foreign matter from the communication passage 104*k* into the back-pressure chamber 410.

In the present embodiment, the passage of the supply passage 145 between the first control valve 300 and the crank chamber 140 is referred to as the downstream side supply passage 145*b*. As illustrated in FIG. 3, the intermediate supply passage 145*b*1 of this downstream side supply passage 145*b* between the first control valve 300 and the check valve 350 extends substantially linearly. That is, no bent portion that is greatly bent is formed at any midpoint of the intermediate supply passage 145*b*1. As a result, in the intermediate supply passage 145*b*1, it is possible to form a mainstream refrigerant flow in which the refrigerant flows linearly from the first control valve 300 toward the check valve 350. As a result, it is possible to more reliably prevent or suppress intrusion of foreign matter into the back-pressure chamber 410.

In the present embodiment, over the entire length of the communication passage, the communication passage 104*k* extends at an acute angle with respect to the communication passage 104*d* as the intermediate supply passage side connection portion. As a result, in cooperation with the connection portion 104*e* and the communication passage 104*d*, there is formed a V-shaped passage, making it possible to more reliably prevent or suppress intrusion of foreign matter from the connection portion 104*e* into the back-pressure chamber 410.

In the present embodiment, the communication passage 104*k* is formed such that the back-pressure chamber side opening end opens, in the installed state of the compressor, at a lower portion in the gravitational direction of the inner wall surface of the back-pressure chamber 410. As a result, when the first control valve 300 closes the supply passage 145, and the refrigerant of the intermediate supply passage 145*b*1 is discharged into the suction chamber 141 via the back-pressure relief passage 147, even if foreign matter enters the back-pressure chamber 410 via the communication passage 104*k*, the foreign matter is easily discharged to the connection portion 104*e* side due to the gravitational force via the communication passage 104*k*.

In the present embodiment, the connection portion 104*e* of the intermediate supply passage 145*b*1 is arranged such that, in the installed state of the compressor, it is situated on the lower side in the gravitational direction of the second control valve 400. As a result, the connection portion 104*e* is situated on the lower side in the gravitational direction of the back-pressure chamber 410 of the second control valve 400, so that it is difficult for foreign matter to enter the back-pressure chamber 410 via the communication passage 104*k*, and even if it is allowed to enter, the foreign matter can be easily discharged.

In the present embodiment, in the cylinder head 104, the first control valve 300 and the second control valve 400 are arranged at positions mutually deviated in a direction orthogonal to the extending direction of the axis O of the drive shaft 110 (that is, the center axis extending direction of the compressor housing). More specifically, the first control valve 300 is arranged vertically below the second control valve 400. As a result, the connection portion 104*e*, the communication passage 104*d* as the connection passage, and the second control valve 400 can be collectively arranged below the second control valve 400, so that it is possible to shorten the length in the longitudinal direction (the extending direction of the axis O of the drive shaft 110) of the variable displacement compressor 100 as compared with that in the prior art, with the result it is possible to achieve a reduction in the size of the compressor housing.

In the present embodiment, the distance between the valve seat side end surface 442*a* of the valve portion 442 and the dividing member side end surface 441*b* of the pressure receiving portion 441 is set such that in the state in which the valve portion 442 is in contact with the valve seat 103*f*, the pressure receiving portion 441 abuts the pressure receiving portion side end surface 432*b* of the dividing member 430, whereby the communication between the back-pressure chamber 410 and the valve chamber 420 via the gap between the through-hole 432*a* formed in the dividing member 430 formed for the insertion of the shaft portion 443 and the shaft portion 443. The back-pressure relief passage 147 is formed so as to bypass the second control valve 400 and to establish direct communication between the connection portion 104*e* of the intermediate supply passage 145*b*1 and the suction chamber 141. As a result, when the first control valve 300 is open, there is no, or substantially no, constant refrigerant flow in the back-pressure chamber 410, making it possible to further suppress intrusion of foreign mater into the back-pressure chamber 410.

In the present embodiment, the throttle portion 147*a* of the back-pressure relief passage 147 is formed in the discharge valve forming plate 151. Due to this structure, the back-pressure relief passage 147 including the throttle portion 147*a* can be formed easily.

Modifications

In the present embodiment, the communication passage 104*k* is formed such that the communication passage side connection portion 104*k*1 extending from at least the connection portion 104*e* of the communication passage 104*k* toward the back-pressure chamber 410 extends at an acute angle with respect to the communication passage 104*d* extending from the connection portion 104*e* of the intermediate supply passage 145*b*1 toward the first control valve 300. This, however, should not be construed restrictively. It may extend in some other direction as appropriate. Further, while the communication passage 104*k* is formed such that the back-pressure chamber side opening end of the communication passage 104*k* opens in the inner wall surface of the back-pressure chamber 410, this should not be construed restrictively. It may open in the hole bottom surface 104*g*3 of the accommodating hole 104*g*. Further, while in the above-described example one end of the communication passage 104*k* opens in the connection portion 104*e* of the intermediate supply passage 145*b*1, this should not be construed restrictively. It is only necessary for one end of the communication passage 104*k* to open at an appropriate portion of the intermediate supply passage 145*b*1. For example, it may open in the third region S3 of the accommodating hole 104*c* of the first control valve 300.

Figure 10:
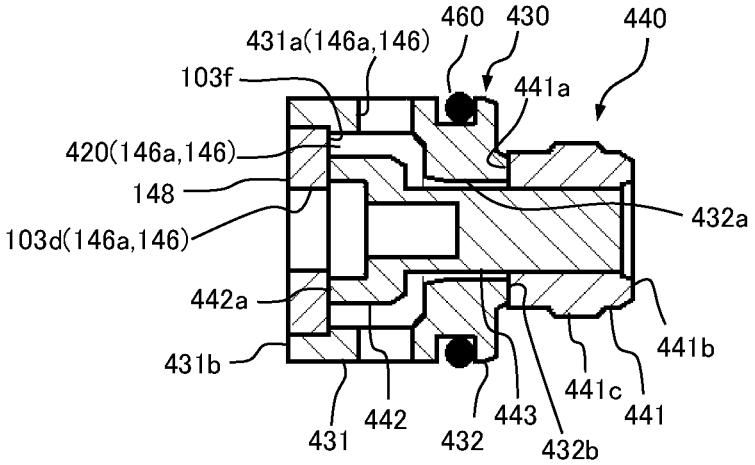
FIG. 10 is a sectional view illustrating a modification of the second control valve.

While in the present embodiment the open end of the dividing member 430 is closed by the valve plate 103, and the valve plate 103 is used as the valve seat forming member of the second control valve 400, this should not be construed restrictively. As the valve seat forming member of the second control valve 400, a member interposed between the cylinder block 101 and the cylinder head 104 such as the suction valve forming plate 150 or the discharge valve forming plate 151 may be used. As illustrated in FIG. 10, the second control valve 400 may be integrally provided with a dedicated valve seat forming member 148. More specifically, as illustrated in FIG. 10, the valve seat forming member 148 is forced, for example, into the end surface 431*b* side opening of the peripheral wall 431 and fixed. When one of the suction valve forming plate 150, the discharge valve forming plate 151, and the valve plate 103 is used as the valve seat forming member, there is no need to add a dedicated valve seat forming member. Further, this provides a satisfactory flatness, which is suitable for the valve seat forming member.

While in the present embodiment the peripheral wall 431 of the dividing member 430 is slidably supported by the peripheral wall of the second accommodating chamber 104*g*2, this should not be construed restrictively. It may be forced into and fit-engaged with the second accommodating chamber 104*g*2 and set in position in the cylinder head 104. In this case, there is no need to provide the O-ring 460 or the Belleville spring 450.

While in the present embodiment the back-pressure relief passage 147 is formed so as to bypass the second control valve 400 and to establish direct communication between the connection portion 104*e* of the intermediate supply passage 145*b*1 and the suction chamber 141, this should not be construed restrictively. The back-pressure relief passage 147 may extend via the communication passage 104*k* establishing communication between the back-pressure chamber 410 and the intermediate supply passage 145*b*1. In the case of this modification, a communication hole communicating between the back-pressure chamber 410 and the valve chamber 420 is formed in the end wall 432 of the dividing member 430 of the second control valve 400. As a result, there is formed the back-pressure relief passage 147 opening to the suction chamber 141 via the communication passage 104*k*, the back-pressure chamber 410, the interval between the outermost peripheral surface 441*c* of the pressure receiving portion 441 and the inner peripheral surface of the first accommodating chamber 104*g*1, the communication hole formed in the end wall 432, the valve chamber 420, and the discharge hole 431*a*. In the case of this modification, setting is made such that the communication hole communicating between the back-pressure chamber 410 and the valve chamber 420 exhibits a minimum flow passage sectional area in the back-pressure relief passage 147, forming the throttle portion 147*a* of the back-pressure relief passage 147.

While in the present embodiment the discharge passage 146 branches off from the space 101*d* into the first discharge passage 146*a* and the second discharge passage 146*b*, and the first discharge passage 146*a* is opened and closed by the second control valve 400, and the second discharge passage 146*b* is constantly kept open to thereby secure the minimum opening degree of the discharge passage 146 when the second control valve 400 is closed, this should not be construed restrictively. For example, instead of the second discharge passage 146*b*, a through-hole may be formed in the peripheral wall of the valve portion 442, or a groove may be provided in the valve seat side end surface 442*a* of the valve portion 442, thereby securing the minimum opening degree of the discharge passage 146.

While in the present embodiment the shaft portion 443 of the spool 440 is formed integrally with the valve portion 442, this should not be construed restrictively. It may be formed integrally with the pressure receiving portion 441.

While in the present embodiment the variable displacement compressor 100 is formed as a swash plate type clutchless variable displacement compressor, this should not be construed restrictively. It may be formed as a variable displacement compressor to which an electromagnetic clutch is attached, or as a variable displacement compressor driven by a motor.

While the present invention has been specifically described in connection with a preferred embodiment, it is obviously possible for those skilled in the art to produce other various modifications based on the basic technical idea and teachings of the present invention.

REFERENCE SYMBOL LIST

100 variable displacement compressor
101*a* cylinder bore (compressing portion)
103*d* valve hole (valve hole of the second control valve)
103*f* valve seat (valve seat of the second control valve)
104*d* communication passage (intermediate supply passage side connection portion)
104*k* communication passage
104*k*1 communication passage side connection portion
136 piston (compressing portion)
140 crank chamber (control pressure chamber)
141 suction chamber
142 discharge chamber
145 supply passage
145*b* downstream side supply passage
145*b*1 intermediate supply passage
146 discharge passage
146*c* upstream side discharge passage
147 back-pressure relief passage (throttle passage)
147*a* throttle portion
300 first control valve
350 check valve
400 second control valve
410 back-pressure chamber
420 valve chamber
430 dividing member
431 peripheral wall
431*a* discharge hole
432 end wall
432*a* through-hole
440 spool
441 pressure receiving portion
442 valve portion
442*a* valve seat side end surface
442*b* end wall side end surface
443 shaft portion

The invention claimed is:

1. A variable displacement compressor having a suction chamber to which refrigerant is directed, a compressing portion configured to draw in the refrigerant from the suction chamber and compress the refrigerant, a discharge chamber into which the refrigerant compressed by the compressing portion is discharged, and a control pressure chamber, the variable displacement compressor undergoing variation in discharge capacity in response to a pressure of the control pressure chamber, the variable displacement compressor comprising:

a first control valve provided in a supply passage for supplying the refrigerant in the discharge chamber to the control pressure chamber, and controlling an opening degree of the supply passage;

a check valve provided in a downstream side supply passage between the first control valve and the control pressure chamber in the supply passage, the check valve being operable to prevent backflow of the refrigerant flowing from the control pressure chamber toward the first control valve;

a second control valve provided in a discharge passage for discharging the refrigerant in the control pressure chamber into the suction chamber, and controlling an opening degree of the discharge passage; and a throttle passage connecting an intermediate supply passage between the first control valve and the check valve in the downstream side supply passage with the suction chamber in communication therebetween, and having a throttle portion, wherein the second control valve comprises:

a back-pressure chamber communicating with the intermediate supply passage;

a valve chamber communicating with a valve hole and a discharge hole and constituting a part of the discharge passage, the valve hole communicating with an upstream side discharge passage between the second control valve and the control pressure chamber in the discharge passage, the discharge hole communicating with the suction chamber;

a dividing member dividing the back-pressure chamber and the valve chamber from each other, and having a tubular peripheral wall and an end wall connected to one end side of the peripheral wall so that an inner space surrounded by the peripheral wall defines the valve chamber; and a spool having a circular sectional configuration and extending in one direction, the spool having a pressure receiving portion arranged inside the back-pressure chamber, a valve portion arranged inside the valve chamber and configured to move to and away from a valve seat around the valve hole, and a shaft portion extending through a through-hole formed in the end wall of the dividing member, the shaft portion connecting the pressure receiving portion and the valve portion and having an outer diameter smaller than outer diameters of the pressure receiving portion and the valve portion, wherein the second control valve is configured to move the spool in response to a pressure in the back-pressure chamber and a pressure in the upstream side discharge passage so as to move the valve portion to and away from the valve seat, thereby controlling the opening degree of the discharge passage, wherein the valve portion has a valve seat side end surface facing the valve seat, and an end wall side end surface facing the end wall of the dividing member, wherein in a state in which the first control valve closes the supply passage and in which the valve seat side end surface is spaced away from the valve seat to a maximum, the end wall side end surface comes into contact with the end wall, whereby communication between the valve chamber and the back-pressure chamber via the through-hole is cut off, and wherein a distance between the valve portion and the pressure receiving portion is set such that in a state in which the valve portion abuts the valve seat, the pressure receiving portion abuts the dividing member, wherein in a state in which the valve portion abuts the valve seat, the pressure receiving portion abuts the dividing member, whereby communication between the back-pressure chamber and the valve chamber via the through-hole is cut off, and wherein the throttle passage is formed so as to bypass the second control valve and to establish communication between a connection portion provided at some midpoint of the intermediate supply passage and the suction chamber.

2. The variable displacement compressor according to claim 1, wherein the back-pressure chamber communicates with the intermediate supply passage via a communication passage connected to the back-pressure chamber and the intermediate supply passage, wherein one end of the communication passage is connected to the connection portion provided at some midpoint of the intermediate supply passage, and wherein a communication passage side connection portion of the communication passage extending at least from the connection portion toward the back-pressure chamber extends at an acute angle with respect to an intermediate supply passage side connection portion extending from the connection portion toward the first control valve in the intermediate supply passage.

* * * * *